US010739091B2

(12) United States Patent
Mesco et al.

(10) Patent No.: US 10,739,091 B2
(45) Date of Patent: Aug. 11, 2020

(54) AUTOMATIC AND SEMI-AUTOMATIC HANDGUN WITH MAGAZINE ALIGNED AND DISPOSED BENEATH THE BARREL

(71) Applicants: Makin Mesco, Los Angeles, CA (US); Mikhal Mesco, Los Angeles, CA (US); Richard Mesco, Los Angeles, CA (US)

(72) Inventors: Makin Mesco, Los Angeles, CA (US); Mikhal Mesco, Los Angeles, CA (US); Richard Mesco, Los Angeles, CA (US)

( * ) Notice: Subject to any disclaimer, the term of this patent is extended or adjusted under 35 U.S.C. 154(b) by 0 days.

(21) Appl. No.: 16/056,379

(22) Filed: Aug. 6, 2018

(65) Prior Publication Data

US 2020/0041221 A1 Feb. 6, 2020

(51) Int. Cl.
*F41A 9/26* (2006.01)
*F41A 9/73* (2006.01)
(Continued)

(52) U.S. Cl.
CPC ..... *F41A 9/26* (2013.01); *F41A 9/72* (2013.01); *F41A 9/73* (2013.01); *F41C 3/00* (2013.01)

(58) Field of Classification Search
CPC ..... F41A 9/06; F41A 9/07; F41A 9/09; F41A 9/15; F41A 9/17; F41A 9/18; F41A 9/23;
(Continued)

(56) References Cited

U.S. PATENT DOCUMENTS 580,679 A * 4/1897 Davenport ..... F41A 9/72 42/21
601,843 A * 4/1898 McClean ..... F41A 9/18 42/21
(Continued)

FOREIGN PATENT DOCUMENTS

GB 729236 5/1955
WO WO 2008/137187 11/2008

OTHER PUBLICATIONS gunsweek.com, Projects: SMG 15 and SMG 25 bullpup pistols, Sep. 29, 2017, http://www.gunsweek.com.
SRM ARMS, Firearms, https://www.srmarms.com/shotguns.

*Primary Examiner* — Stephen Johnson
*Assistant Examiner* — Benjamin S Gomberg
(74) *Attorney, Agent, or Firm* — Tsircou Law, P.C.

(57) ABSTRACT

A high capacity handgun/pistol is disclosed with a horizontally oriented magazine that is aligned with and disposed beneath the gun barrel. The magazine defines a plurality of hollow tubes arranged radially around a central axis about which the magazine can rotate automatically during operation of the handgun/pistol. The hollow tubes each contain a plurality of ammunition rounds, and can each be aligned with a loading tray one at a time, wherein a coil spring will push out a single round at a time onto the loading tray. The handgun uses a gun slide to load a new round into the chamber via the loading tray, and further enabling the loading tray to automatically rotate the magazine as each hollow tube becomes empty. Moreover, the slide will re-set a hammer to re-engage with a sear, after a pulled trigger releases the hammer to strike a firing pin. The handgun is further equipped with a selector switch enabling automatic and semi-automatic firing modes, wherein the semi-automatic firing mode can be further specified to select a three round burst fire mode. The handgun can also be configured with a simpler firing mode cam and fewer parts that limits it to semi-automatic firing mode. Additionally, the handgun barrel is separable and replaceable if the barrel becomes too hot after rapid fire.

12 Claims, 26 Drawing Sheets

(51) Int. Cl.
*F41A 9/72* (2006.01)
*F41C 3/00* (2006.01)

(58) Field of Classification Search
CPC ..... F41A 9/24; F41A 9/26; F41A 9/68; F41A 9/72; F41A 9/73; F41A 9/74; F41C 3/00
USPC ..... 42/6, 17, 19, 21, 49.01, 60; 89/33.01, 89/33.02, 33.03, 33.04, 33.1, 33.17, 33.5, 89/197
See application file for complete search history.

(56) References Cited

U.S. PATENT DOCUMENTS 618,369 A * 1/1899 Wilson ..... F41A 9/72 42/49.01
1,115,979 A * 11/1914 Sillix ..... F41A 9/23 42/19
1,377,236 A * 5/1921 Watson ..... F41A 9/26 89/139
1,420,471 A * 6/1922 Carter ..... F41A 9/72 42/19
1,839,621 A * 1/1932 Umberto ..... F41A 9/23 42/17
2,041,015 A * 5/1936 Umberto ..... F41A 19/21 42/17
2,237,291 A * 4/1941 Carter ..... F41A 9/72 42/19
3,088,378 A * 5/1963 Boudreau ..... F41A 5/16 124/37
3,322,036 A 5/1967 Jafwert
3,759,135 A 9/1973 Tollinger
3,847,054 A 11/1974 Ruger et al.
3,991,501 A * 11/1976 Larsson ..... F41A 9/73 42/88
4,207,797 A * 6/1980 Gyorik ..... F41A 9/73 42/6
4,619,063 A * 10/1986 Hill ..... F41A 9/68 42/19
4,905,394 A 3/1990 Predazzer
4,905,395 A * 3/1990 Wagner ..... F41A 9/72 42/17
5,119,575 A * 6/1992 Gajdica ..... F41A 9/72 42/19
5,235,769 A * 8/1993 Stead ..... F41A 9/17 42/11
5,367,810 A * 11/1994 Stead ..... F41A 9/72 42/17
6,877,265 B2 4/2005 Hajjar et al.
7,194,834 B2 * 3/2007 Falenwolfe ..... F41A 9/26 42/19
7,380,361 B2 6/2008 Hajjar et al.
7,779,571 B1 8/2010 Roth
8,353,123 B2 * 1/2013 Pullicar ..... F41A 9/72 42/71.01
8,931,467 B2 1/2015 Lee
9,228,786 B2 1/2016 Sullivan et al.
9,581,400 B2 2/2017 Dove
2007/0051236 A1 3/2007 Groves et al.
2008/0121096 A1 * 5/2008 Hajjar ..... F41A 9/72 89/14.3
2017/0299296 A1 10/2017 Dees

* cited by examiner

AUTOMATIC AND SEMI-AUTOMATIC HANDGUN WITH MAGAZINE ALIGNED AND DISPOSED BENEATH THE BARREL

FIELD OF THE INVENTION

The present invention relates generally to firearms and, more particularly, to high capacity handguns configured for automatic and/or semi-automatic firing, while storing magazines beneath and oriented parallel with the barrel.

BACKGROUND OF THE INVENTION

The relatively compact design and configuration of handguns and pistols facilitates ease in portability and usage. The typical design includes, among other components, a grip to hold the firearm, and a barrel and gun slide located perpendicular to the grip. The location of the ammunition rounds will depend on the type of gun, but often time ammunition rounds are stored in a magazine located within the grip. This location optimizes the use of the handgun dimensions, considering the standard magazine does not require any other separate compartments that would bulk up the handgun. This is particularly important for those that are required to carry a firearm while being mobile or in constricted settings, such as police officers and many military personnel.

Most types of civilian handguns are semi-automatic, in that only one round will be fired with a single trigger pull. A subset of semi-automatic handguns are "autoloaders", in that the firearm will automatically load a new round to be fired after each successive firing. The typical re-loading mechanism after a round is fired involves the gun slide moving backwards to re-load a new round, and reset the handgun such that it will not fire until the trigger is released and pulled again. A fully automatic weapon differs in this respect in that a pulled and held down trigger results in consecutive rounds being fired.

Fully automatic handguns can be transferred or sold in the U.S. only to federal agencies under Public Law 99-308 (1986). More specifically, fully automatic pistols are typically issued in the modern military as personal side arms to commanding officers and senior NCOs, special forces operatives, and to combat personnel who operate in cramped spaces where an assault rifle or carbine is impractical, such as vehicle drivers, artillery and tank crews, pilots, aircraft and helicopter crews, and marine and naval personnel. However, considering the compact design of a side arm is what offers the user ease in portability, the same compact design limits the number of rounds it is capable of holding without adding more to its size, thereby frustrating the use of such a weapon in automatic firing mode since frequent re-loading of ammunition magazines will be required.

The grip of a gun is primarily designed for the user to hold and safely fire the weapon. Adding a larger magazine generally requires the grip to be larger and can increase the overall dimensions of the pistol and therefore make it incompatible with its intended purpose, unable to be concealed, unwieldy, and even unsafe for a user. Although there are handguns that have magazines oriented below and parallel with the gun barrel, the rounds are oriented perpendicular to the barrel, such that an internal mechanism is required to re-orient the round for firing. Overall, large capacity handguns, particularly those that contain complex mechanisms that increase their size and weight, are much bulkier and more massive than the average small capacity handgun of the same caliber, which make it difficult for them to be used as a sidearm. Moreover, limited capacity handguns not only impact automatic firing but those handguns configured for semi-automatic firing as well, such as for personnel in government agencies that include undercover police officers, which contain a limited round capacity held by current concealable side arm designs.

It should, therefore, be appreciated that there exists a need for a high capacity handgun side arm configured for automatic, semi-automatic, and/or three-burst firing, with minimal to no increase in the overall dimensions and mass of a standard capacity gun, other than the weight of the additional ammunition rounds, and without the need for mechanisms to re-orient the stored ammunition rounds. The present invention fulfils this need and others.

SUMMARY OF THE INVENTION

Briefly, and in general terms, the invention is embodied in a handgun and pistol ("handgun") with a horizontally oriented magazine that is aligned with and disposed below the gun barrel. The magazine, stored within a magazine well, can contain a plurality of hollow tubes arranged radially about a central axis about which the magazine can rotate. Each of the hollow tubes can hold a plurality of ammunition rounds ("round"), wherein the handgun is configured to load one ammunition round at a time to the chamber of the gun barrel while the handgun is being fired.

More specifically, by example and not limitation, each hollow tube contains a coil spring that exerts tension on the ammunition rounds stored within. A rearward motion of a gun slide will enable a loading tray, aligned with a hollow tube within the magazine, to lift a single round to a position where it can be loaded into the chamber of the gun barrel.

In a detailed aspect of an exemplary embodiment, a returning, forward motion of the slide enables the round to be loaded within the chamber of the gun barrel, and further lowers the loading tray to receive the next round to be fired. As the loading tray is lowered, it contains a protruding bracket on its fore-end that can catch a spring guide-cap tip protruding from an empty hollow tube so as to automatically rotate the magazine and align the next hollow tube for ammunition round loading.

In another detailed aspect of an exemplary embodiment, each hollow tube is partially covered by a corresponding tube leaf spring preventing the ammunition rounds from being pushed out by the respective coil-spring. A leaf spring release pin on the gun frame displaces the tube leaf spring for a hollow tube aligned with a loading tray thereby allowing the ammunition rounds to be released.

In yet another detailed aspect of an exemplary embodiment, a registration spring system rotationally secures the magazine, wherein a registration spring assembly catches a registration notch of a plurality of registration notches circumscribing the magazine muzzle end, to inhibit the magazine from rotating beyond a displaced tube leaf spring position. Alternatively, the plurality of registration notches can be located anywhere along the magazine body, with the registration spring assembly affixed to the magazine guide. Each tube leaf spring displaced position corresponds to a respective registration notch. The registration spring assembly can be a leaf spring assembly or coil-spring assembly.

In another detailed aspect of an exemplary embodiment, the magazine well is defined by a gun frame and an adjacently located magazine guide that can be released and oriented at an angle away from the gun frame, to enable a magazine to be inserted and/or replaced within the magazine well. The magazine contains a rotating pin that will be placed within an inset of the magazine well (gun frame), serving as a means for the magazine to rotate and as a means for securing the magazine within the magazine well.

In yet another detailed aspect of an exemplary embodiment, a pulled handgun trigger results in a cam to move forward, causing a cam-sear connector and consequently a sear to move forward as well. A hammer, under tension from a hammer-spring assembly, is held in place via the sear. The hammer is released once the sear is moved forward, allowing the hammer to strike a firing pin within the slide, resulting in a detonation and release of the ammunition round. The gun slide will move rearward due to the recoil from the fired round, further forcing the hammer to rotate against the hammer spring assembly, placing it under tension, and to re-engage with the sear. The rearward motion of the slide will also expel the spent round.

In yet another detailed aspect of an exemplary embodiment, the handgun contains a selector switch enabling the handgun to fire in automatic or semi-automatic mode. In automatic firing mode, where the handgun will fire rounds consecutively with a trigger that is held down, the selector switch will position a cam-sear connector pin that prevents the cam-sear connector from reverting back to the original position when the cam is moved forward. As such, the sear is prevented from re-engaging with the hammer that has returned due to the recoil of the fired round. An auto-sear is present to prevent the hammer from striking the firing pin prior to the slide returning forward sufficiently to load a new round and seal the chamber.

In yet another detailed aspect of an exemplary embodiment, the handgun in a semi-automatic firing mode limits the firing and re-loading to one ammunition round each time the trigger is pulled, regardless if the trigger is held down. When the trigger is pulled, the cam is configured to move the cam-sear connector forward just long enough for the sear to release the hammer, after which the cam-sear connector will slip over the cam causing the sear to return to its original position, and re-engage with the hammer that returns after a round is fired.

In yet another detailed aspect of an exemplary embodiment, the handgun is capable of three round firing burst, which allows for three rounds to be fired consecutively with a pulled trigger, facilitated through the use of a sear arm located about the sear, and an inhibitor cog acting as a cam about the hammer. The inhibitor cog circumference defines four shallow recesses and two deep recesses. A first fired round will result in the hammer to partially rotate the inhibitor cog, causing the sear arm to engage with a shallow recess on the inhibitor cog, which, in turn inhibits the sear from re-engaging with the hammer and enabling the hammer to move upwards again. After a third consecutive round has been fired, the inhibitor cog will have rotated sufficiently such that the sear arm engages a deep recess, which results in the sear to re-engage with the hammer and prevent any further firing.

In yet another detailed exemplary embodiment, the handgun is embodied with a removable barrel, enabling a user to switch out a hot barrel, due to rapid fire use, with a cool barrel.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 3:
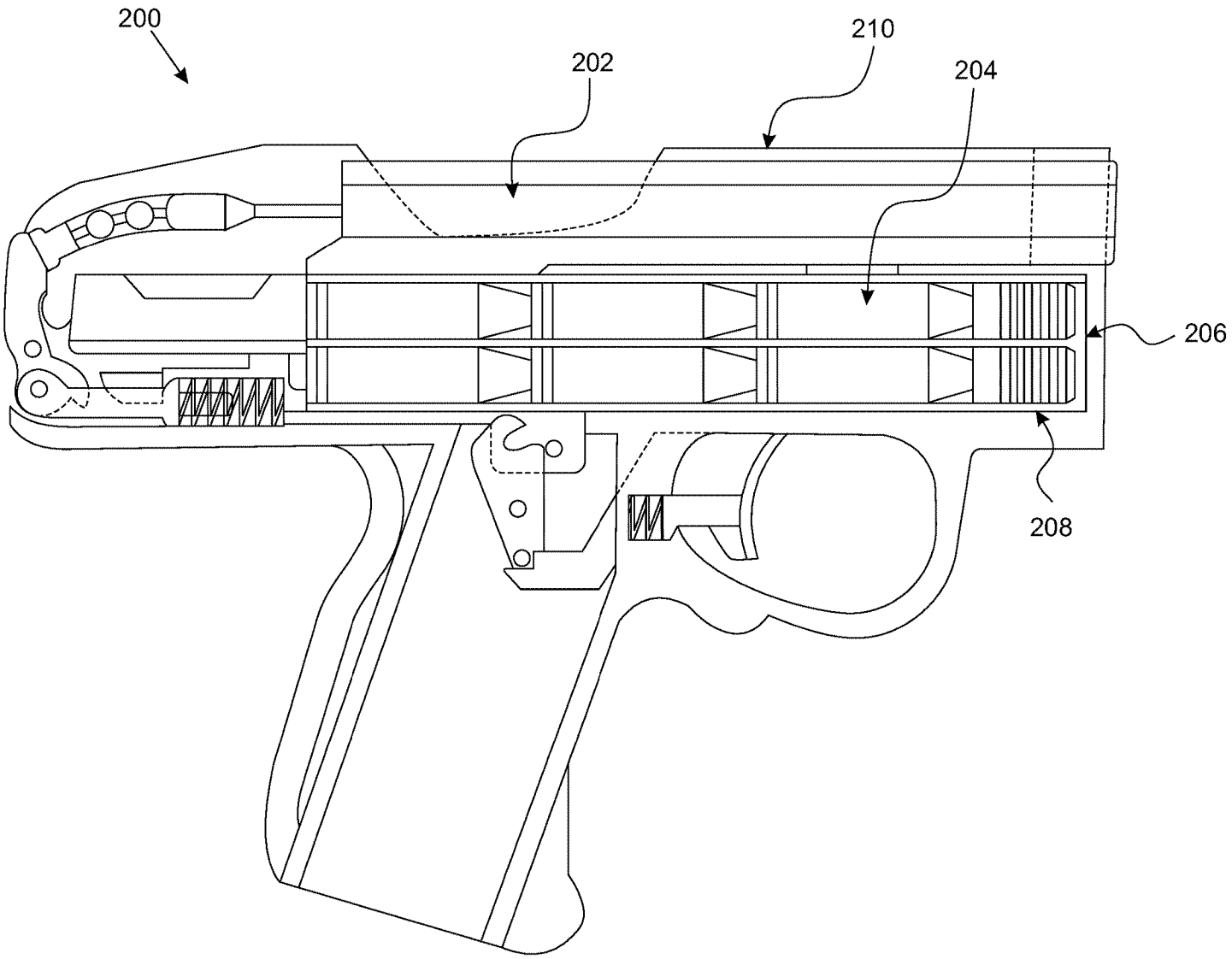
FIG. 3 is a side cutaway view of a handgun in accordance with the invention, depicting a loaded magazine for large caliber ammunition, aligned and disposed beneath the barrel.
Figure 4:
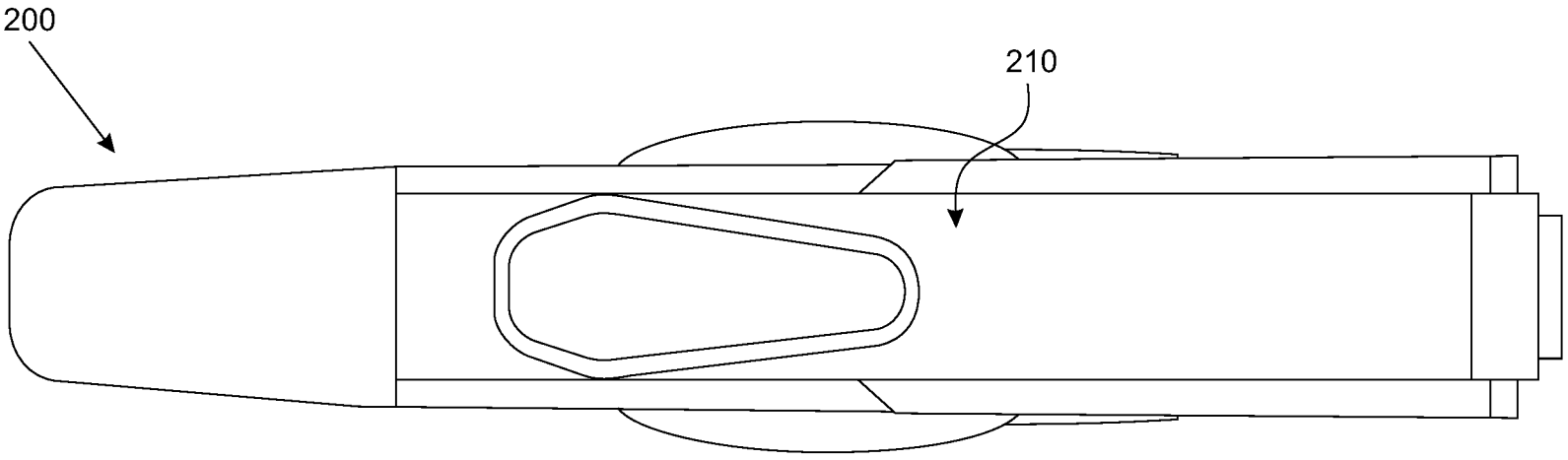
FIG. 4 is a top view of the handgun in FIG. 3, depicting a gun slide, barrel, and stored magazine disposed within a magazine well.

Referring now to the drawings, and particularly FIGS. 1-4, there is shown a handgun 10, 200 with a magazine well 12,208 that is aligned with and disposed below the handgun barrel 14,202. Each handgun 10,200 is equipped with a handgun slide 42,210 ("slide") mounted on top of the handgun barrel 14,202. Referring now to FIG. 3, a magazine 206 is shown as being loaded horizontally into a magazine well 208, wherein multiple hollow tubes holding ammunition rounds "round" 204 are shown as oriented parallel with the handgun barrel 202. As such, a handgun can be equipped with a high capacity magazine with rounds stored in an orientation that enables quick loading for various handgun firing modes.

Figure 1:
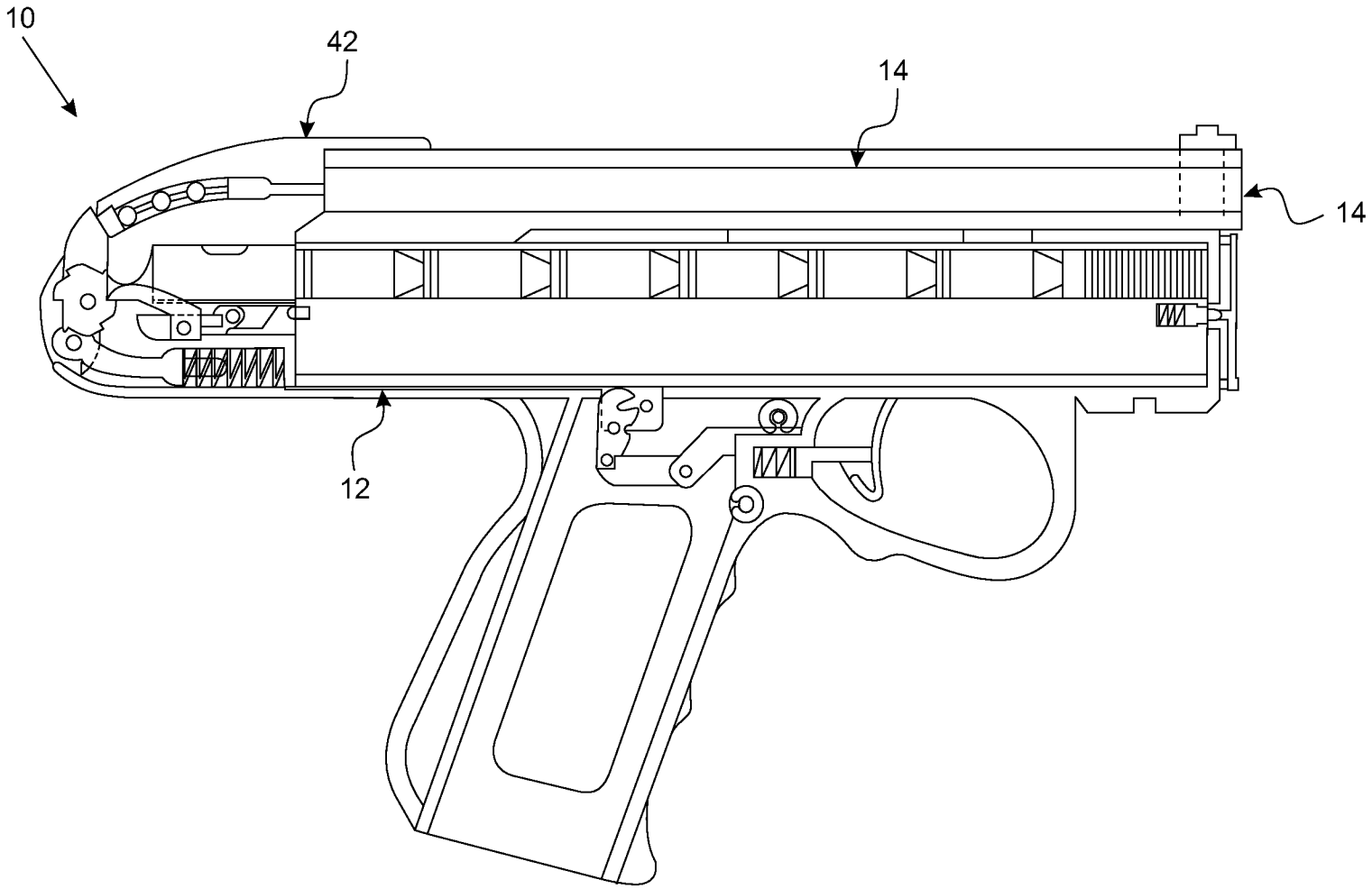
FIG. 1 is a side cutaway view of a small to medium caliber handgun in accordance with the invention, depicting a gun slide, barrel and loaded magazine disposed within a magazine well.
Figure 2:
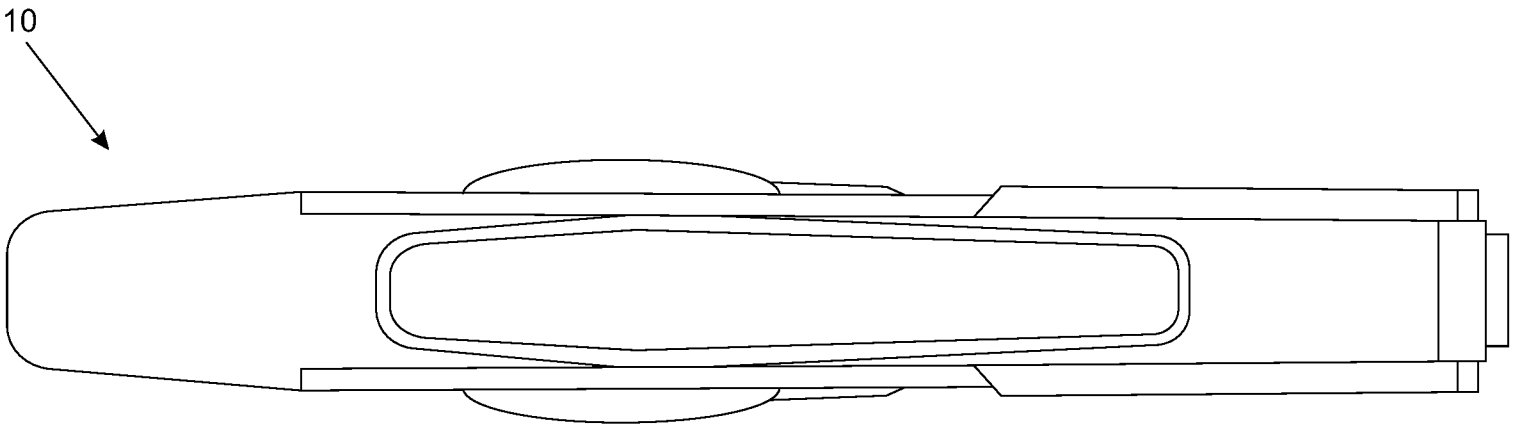
FIG. 2 is a top view of the handgun in FIG. 1, depicting a gun slide, barrel, and stored magazine disposed within a magazine well.
Figure 5:
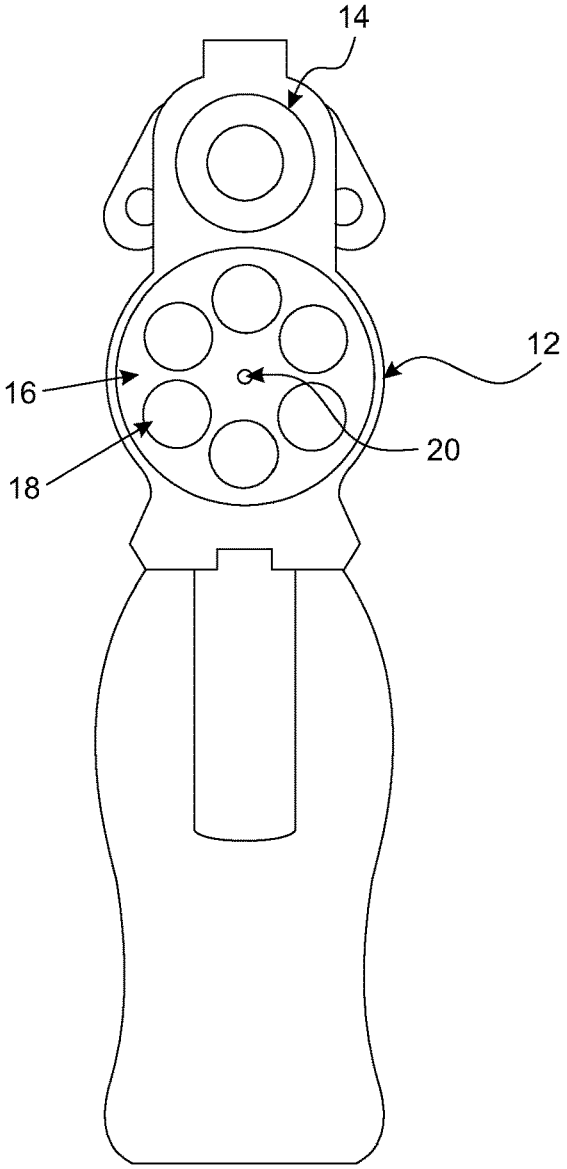
FIG. 5 is the front view of the handgun in FIG. 1, depicting a front cutaway view of the magazine well with a loaded 24, 30, or 36 round magazine of small caliber ammunition.
Figure 6:
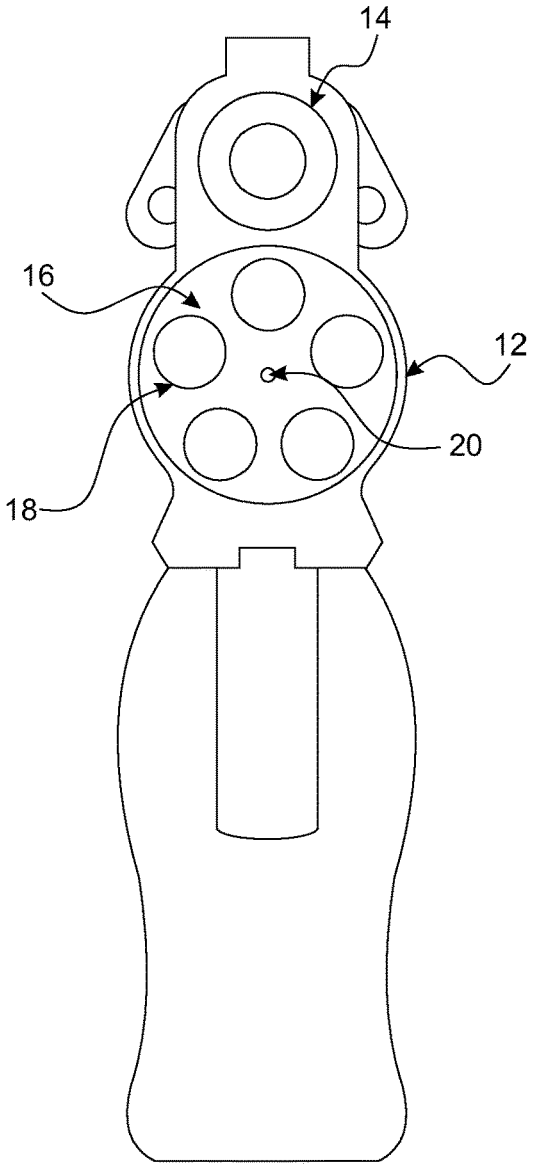
FIG. 6 is the front view of the handgun in FIG. 1, depicting a front cutaway view of the magazine well with a loaded 20, 25, or 30 round magazine of medium caliber ammunition.
Figure 7:
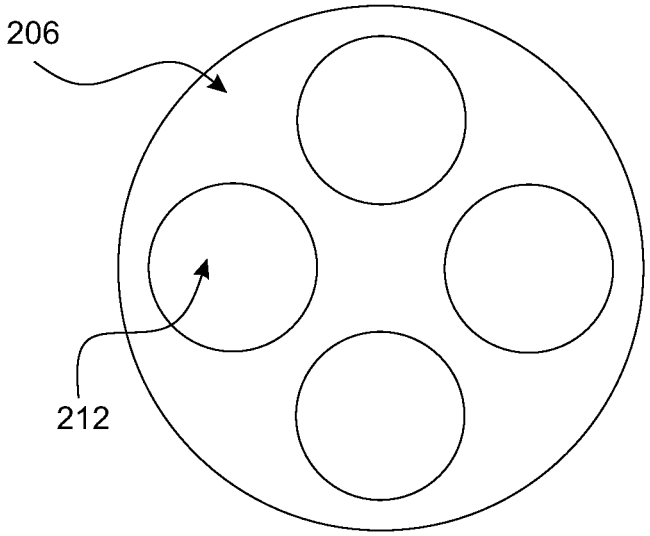
FIG. 7 is a front view of the magazine well of the handgun in FIG. 3, depicting a front cutaway view of the magazine well with a loaded 12, 16, or 20 round magazine of large caliber ammunition.
Figure 8:
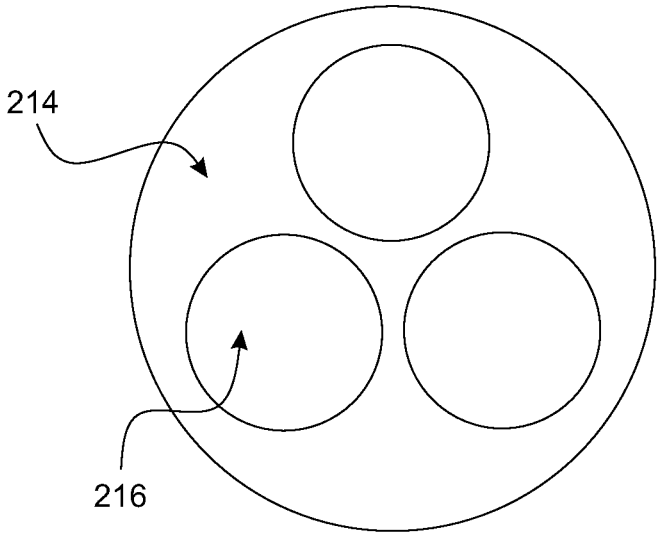
FIG. 8 is a front view of the magazine well of the handgun in FIG. 3, depicting a front cutaway view of the magazine well with a loaded 6, 9, or 12 round magazine of large caliber ammunition.

With reference now to FIGS. 5-6, there is shown a front view of the exemplary embodiment based on the handgun depicted in FIG. 1. The magazine well 12 is configured to receive a magazine 16 that defines a plurality of hollow tubes 18 arranged in a radial fashion about a central axis 20. The magazine 16 itself can be cylindrical, wherein the front end, side, and rear end of a cylindrical magazine 16 are depicted in FIGS. 5-6, FIG. 9, and FIG. 13 respectively. Each of the plurality of hollow tubes 18 can hold a plurality of rounds 22 wherein the number of rounds 22 contained depends on the ammunition caliber inserted. For example, for the exemplary embodiment, a magazine configured for 9 mm caliber rounds (FIG. 6) can contain five hollow tubes 18 that each hold five or six rounds, thereby providing a 25 or 30 round magazine. By contrast, in an alternative embodiment, a magazine 206 configured for .357 caliber rounds (FIG. 7) can contain four or five hollow tubes 212 that each holds three or four rounds, thereby providing a 12, 15, 16 or 20 round magazine. In yet another alternative embodiment, a handgun can equip a magazine 214 configured for .5 caliber rounds (FIG. 8), wherein the magazine 214 can contain three or four hollow tubes 216 that each hold two, three, or four rounds, thereby providing a 6, 9, 12, or 16 round magazine.

Figure 9:
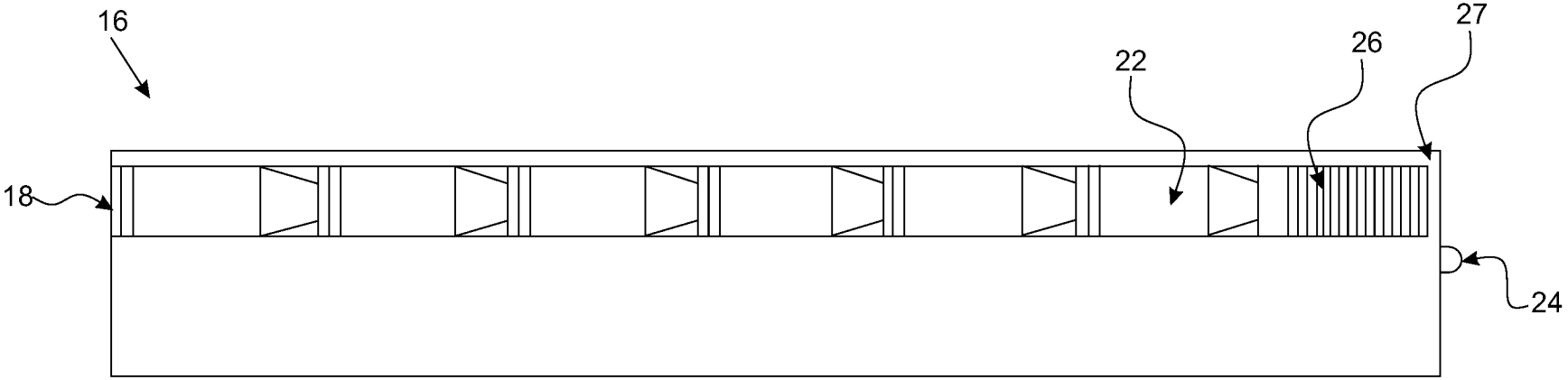
FIG. 9 is a side cutaway view of a magazine for the handgun in FIG. 1, depicting a loaded hollow tube wherein the ammunition rounds are under tension from a coil spring within the hollow tube.
Figure 10:
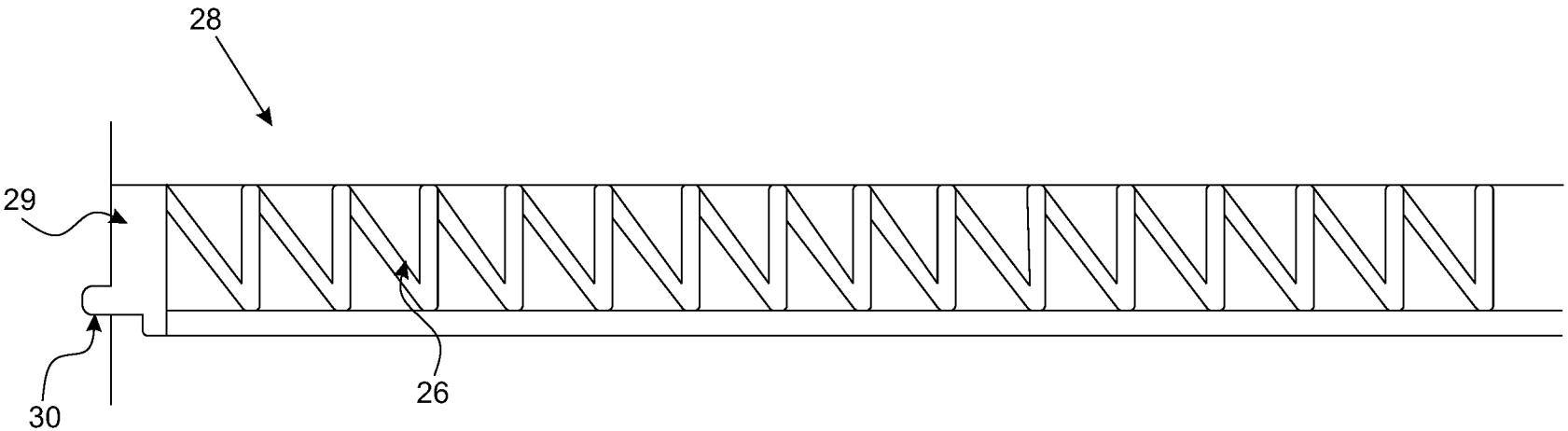
FIG. 10 is a top cutaway view of a magazine for the handgun in FIG. 1, depicting an empty hollow tube with a spring guide groove, spring, and spring guide-cap.
Figure 11:
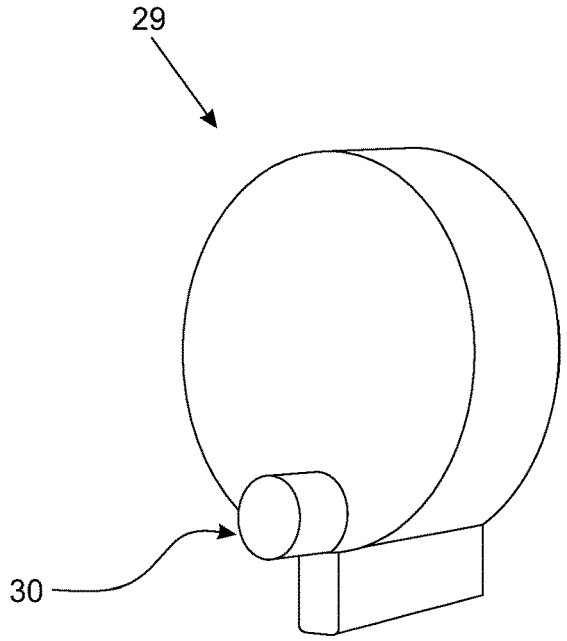
FIG. 11 is a front perspective view of a spring guide-cap in accordance with the invention, depicting a spring guide-cap tip protruding from the spring guide-cap on one surface.
Figure 12:
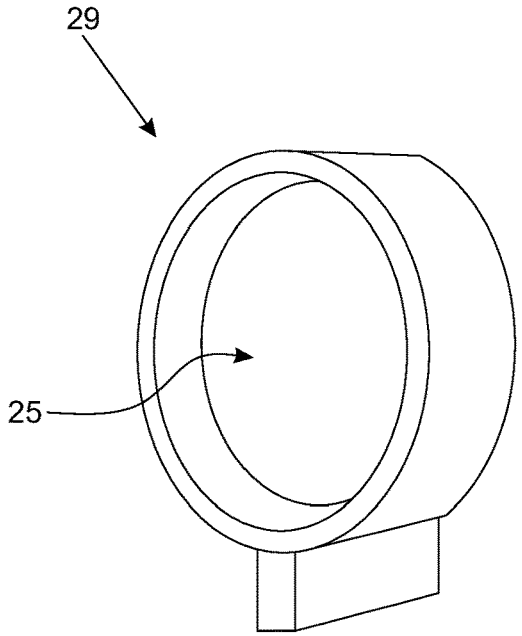
FIG. 12 is a rear perspective view of the spring guide-cap in FIG. 11, depicting a recess to receive a coil spring within a respective hollow tube.

Referring now to FIGS. 5-6 and 9, there is shown a front and side view of a magazine for the exemplary embodiment. The central axis 20 surrounded by the hollow tubes 18 is defined by a magazine rotating pin 24 that is secured in an inset at the front of the magazine well 12 (described further below). The magazine rotating pin 24 enables the magazine 16, and thus the hollow tubes 18, to rotate about the central axis 20 within the magazine well 12, which as further described below, facilitates the loading of rounds 22 from each of the radially arranged hollow tubes 18 to the chamber of the gun barrel.

As aforementioned, the magazine well 12, and consequently magazine 16, is oriented parallel to the gun barrel 14. Referring to FIGS. 9-12, the rounds 22 within the magazine 16 are under tension from a coil spring 26 originating from the muzzle end 27 (front) of each hollow tube 18. Fitted over the chamber end of each coil spring 26 is a spring-guide-cap 29 that is in contact with the first round 22 loaded into a respective hollow tube. The spring-guide-cap 29 contains a tip 30 that will protrude from the opening of an empty hollow tube 28 when the spring is fully extended, wherein the protruding tip 30 is used for automatically rotating the magazine (as further described below). The spring-guide cap 29 also contains a recess 25 to receive the chamber end of a respective coil spring 26.

Figure 13:
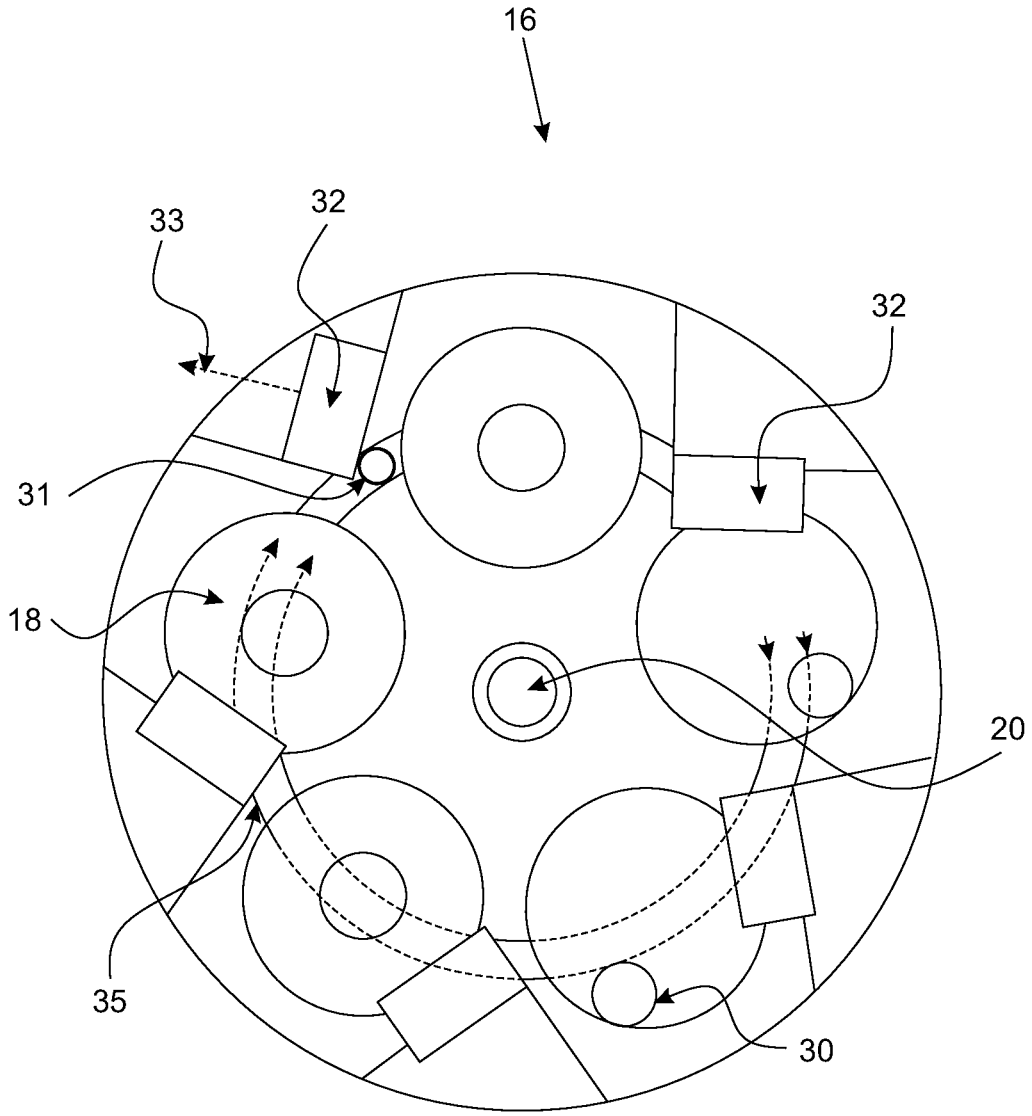
FIG. 13 is a rear view of a magazine for the handgun in FIG. 1, depicting hollow tubes arranged radially with corresponding tube leaf springs, a leaf spring release pin, and a circular groove that defines the leaf spring release pin path as the magazine rotates.
Figure 14:
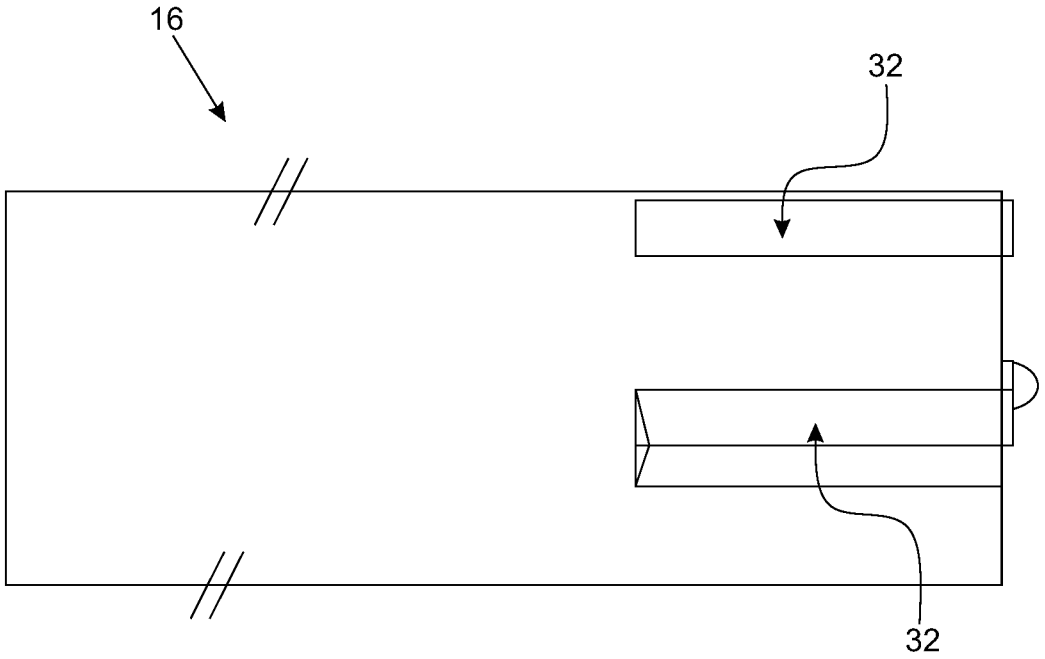
FIG. 14 is a top view of a magazine for the handgun in FIG. 1, depicting a tube leaf spring on the exterior of the magazine.
Figure 15:
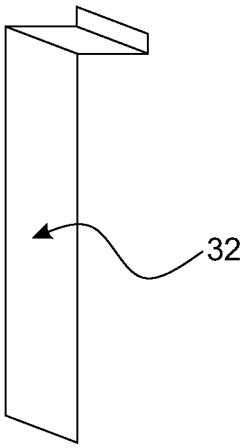
FIG. 15 is a front perspective view of a tube leaf spring in accordance with the invention, depicting a configuration that enables it to be secured to the magazine.

With reference now to FIGS. 13-15, a tube leaf spring 32 partially covers each hollow tube 18 opening (rear of the magazine), thereby preventing the rounds from being pushed out due to the tension from the respective coil spring 26 (FIG. 9). The tube leaf spring 32 is configured (FIG. 15) in a manner that enables for it to be secured to the exterior of the rear-end of the magazine, as shown in a FIGS. 13-14. As described below, a loading tray is used to facilitate the transfer of rounds from the magazine 16 to the handgun barrel chamber, one round at a time. The loading tray will be aligned with only one hollow tube 18 at a time. A tube leaf spring can only be disengaged/displaced 33 once the corresponding hollow tube is aligned with the loading tray, wherein a leaf spring release pin 31 protruding from the gun frame will effectuate the leaf spring disengagement. After the respective hollow tube is emptied and the magazine rotates, the leaf spring release pin 31, resting in a guide groove 35, displaces the next tube leaf spring 32, enabling the release of the next course of ammunition in the same manner described above. The previously displaced tube leaf spring will return to its original position once the respective empty hollow tube is no longer aligned with the loading tray. Moreover, each displaced tube leaf spring will exert a force on the magazine in the direction of the magazine rotation, wherein as described below, a registration spring system will provide rotational stability to the magazine. The exemplary magazine 16 depicted in FIG. 13 shows the magazine rotating clockwise as actuated by the loading tray (not shown) catching a respective spring guide-cap tip 30 (described further below).

Figure 16:
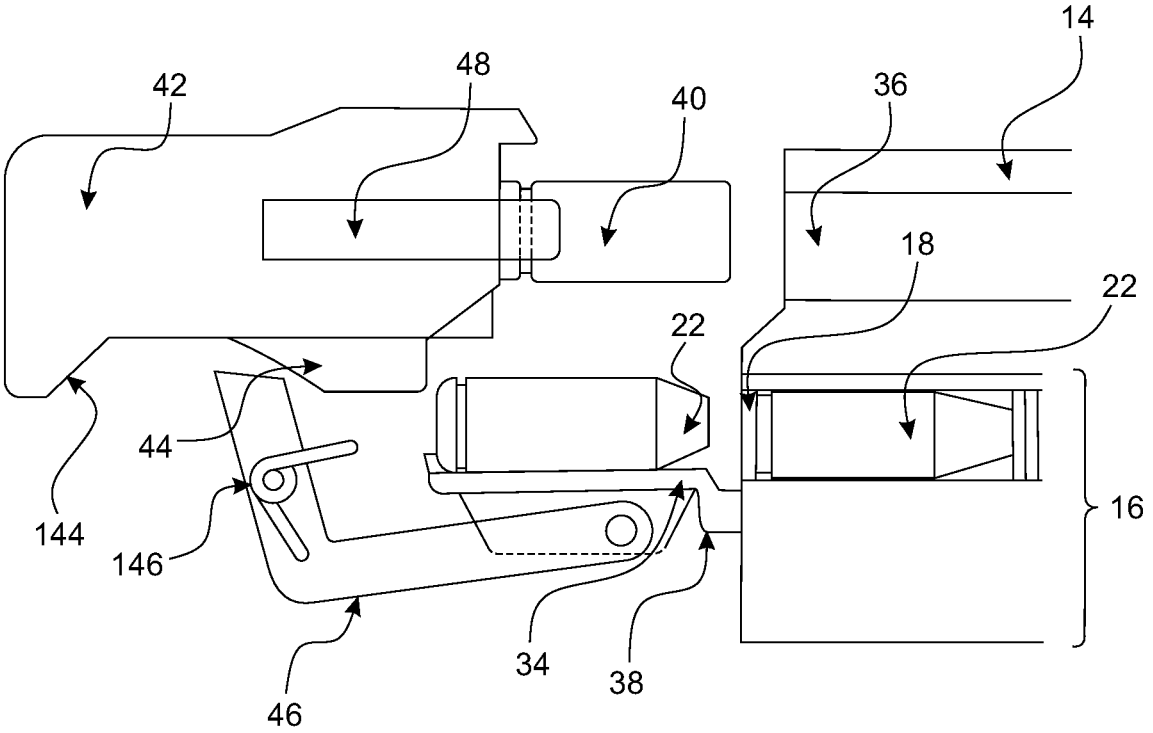
FIG. 16 is a side cutaway view of the handgun in FIG. 1, depicting a loading tray aligned with a loaded hollow tube, a loading tray lever, and a slide with an extractor gripping a spent round.
Figure 17:
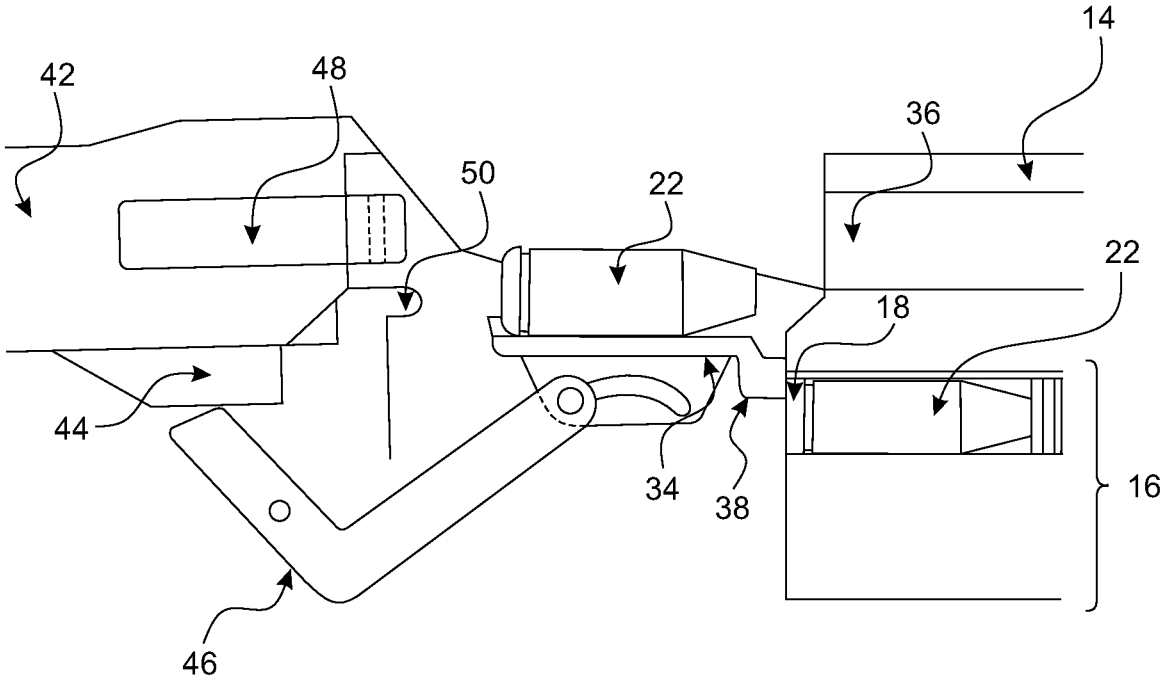
FIG. 17 is a side cutaway view of the handgun in FIG. 1, depicting a lifted loading tray positioning a round behind the gun chamber.
Figure 18:
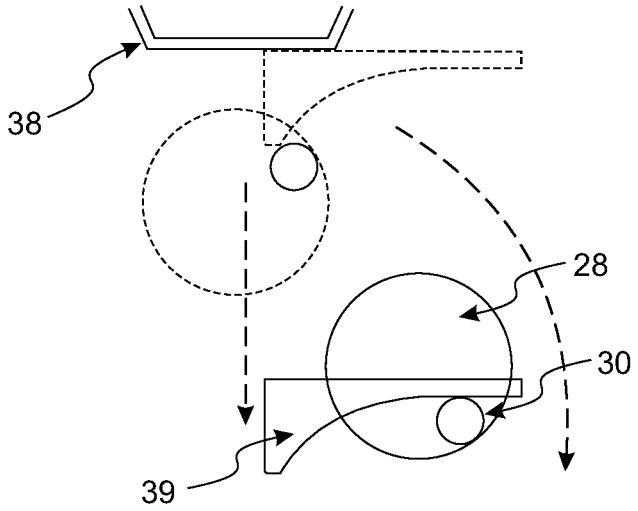
FIG. 18 shows a rear progressive view of a magazine for the handgun in FIG. 1, depicting the rotational movement and direction of the magazine, as actuated by a bracket, affixed to a loading tray, catching a spring guide-cap tip protruding from an empty hollow tube.

With reference now to FIGS. 16-18, the handgun contains a loading tray 34 which, in its original position as depicted in FIG. 16, is aligned with one of the radially arranged hollow tubes 18. The loading tray 34 is further configured to receive and hold one round 22 of ammunition at a time, as pushed out by the coil spring of the aligned hollow tube 18. As described further below, a cycled motion of the gun slide 42, moving rearward and returning forward, will lift the loading tray 34 to position the round in a location where it can be loaded into the chamber 36 of the gun barrel (FIG. 17), after which the loading tray 34 will be returned to its original position (FIG. 16). Each successive firing of the handgun will result in the cycled motion of the gun slide 42, wherein the loading tray 34 will continue to deliver rounds 22 from a given hollow tube 18 until it is empty.

Once a given hollow tube is empty 28, the spring guide-cap tip 30, as aforementioned, will protrude from an empty hollow tube 28. The loading tray 34 contains a protruding bracket 39 (FIG. 18) on its fore-end 38 (FIGS. 16-18), such that, as the loading tray 34 is returning to its original position after delivering a round 22, the bracket 39 will catch the protruding spring guide-cap tip 30 of the emptied hollow tube 28, thereby causing the magazine 16 to rotate about the central axis. The resulting magazine 16 rotation aligns the loading tray 34 with the hollow tube 18 located adjacent to the emptied hollow tube 28. The loading tray 34 will subsequently continue to load rounds 22, and automatically rotate the magazine 16 as each hollow tube becomes empty. As such, the handgun configuration enables for the automatic loading of rounds 22 even if they are stored in separate compartments, i.e. hollow tubes, of a magazine 16.

Figure 41:
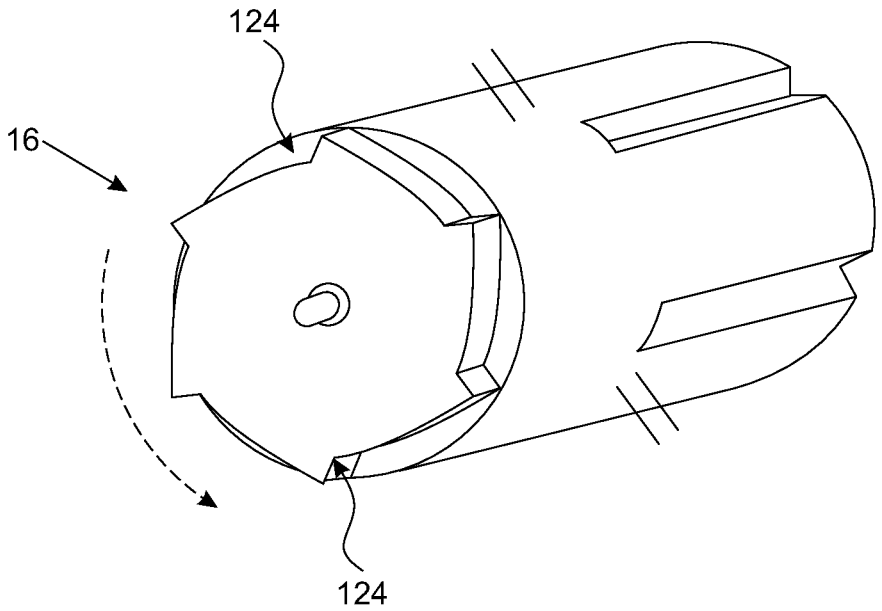
FIG. 41 is a front perspective view of a magazine for the handgun in FIG. 1, depicting a plurality of leaf spring notches configured for a registration leaf spring system, the leaf spring notches circumscribing the front end of the magazine.
Figure 42:
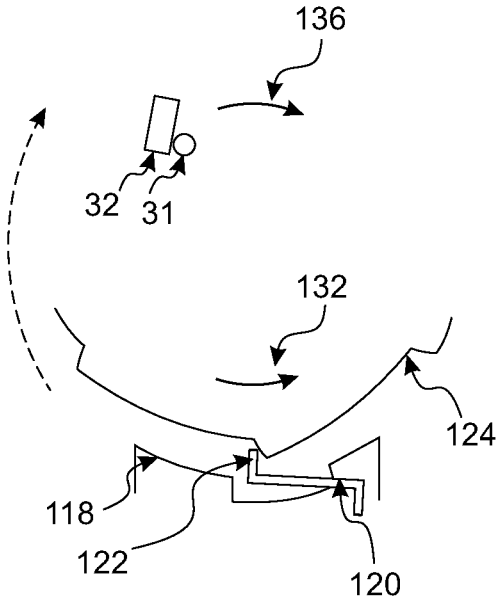
FIG. 42 is a rear cutaway view of a magazine for the handgun in FIG. 1, depicting a registration leaf spring assembly positioned within a leaf spring notch, and further depicting the opposing forces exerted on the magazine.
Figure 43:
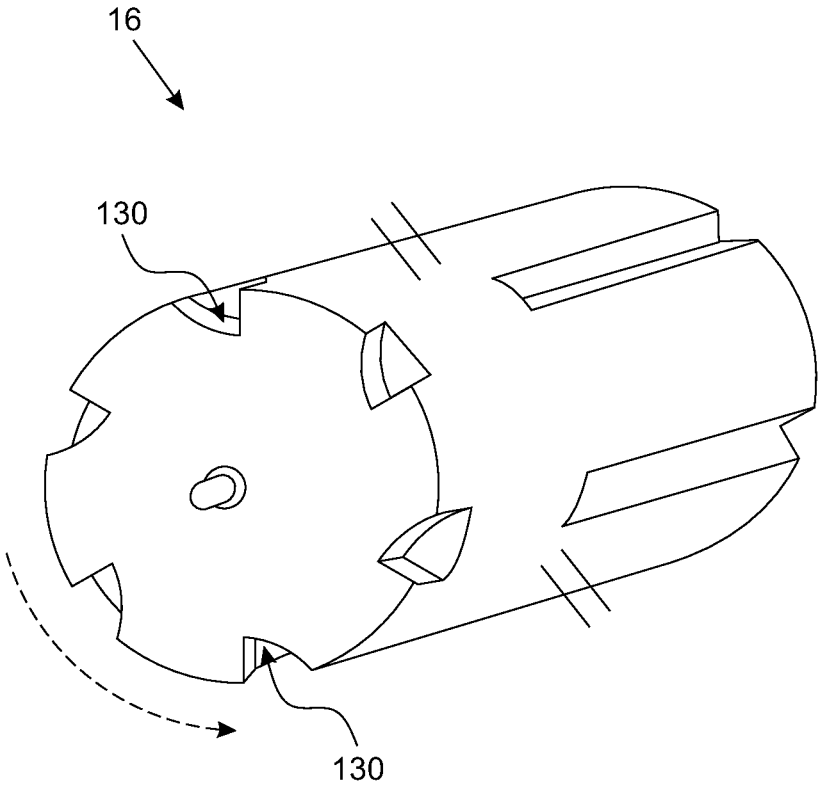
FIG. 43 is a front perspective view of a magazine for the handgun in FIG. 1, depicting a plurality of coil-spring notches configured for a registration coil-spring system, the coil-spring notches circumscribing the front end of the magazine.

With reference now to FIGS. 41-44, there are shown two embodiments of a registration spring system configured to provide rotational stability for the magazine 16, thereby ensuring a respective hollow tube remains aligned with the loading tray. Referring specifically to FIGS. 41-42, there is shown a first embodiment of a registration spring system comprising of an alignment leaf spring assembly 120 and a plurality of corresponding leaf spring registration notches 124 that circumscribe the muzzle end of the magazine 16. The alignment leaf spring assembly 120 comprises of a Z-shaped lever 122, wherein each leaf spring registration notch 124 is configured to securely catch the Z-shaped lever 122. Alternatively, referring specifically to FIGS. 43-44, there is shown a second embodiment of a registration spring system comprising of a coil-spring assembly 126 and a plurality of corresponding coil-spring registration notches 130 that circumscribe the muzzle end of the magazine 16. The coil-spring assembly 126 further comprises a coil-spring lever 128, wherein each coil-spring registration notch 130 is configured to securely catch the coil-spring lever 128.

Figure 19:
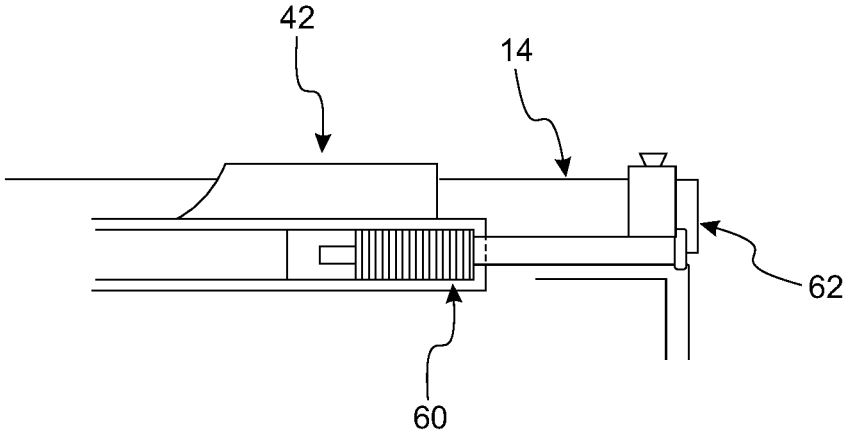
FIG. 19 is a side view of the handgun in FIG. 1, depicting a gun slide pulled by dual springs, and the muzzle of the barrel.
Figure 20:
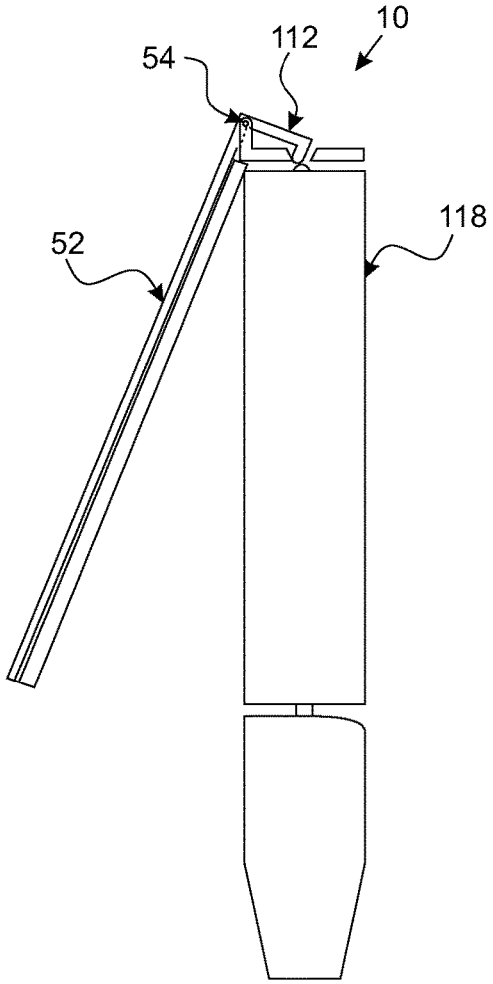
FIG. 20 is a top view of the handgun in FIG. 1, depicting a magazine guide released and rotated away from the gun frame.
Figure 21:
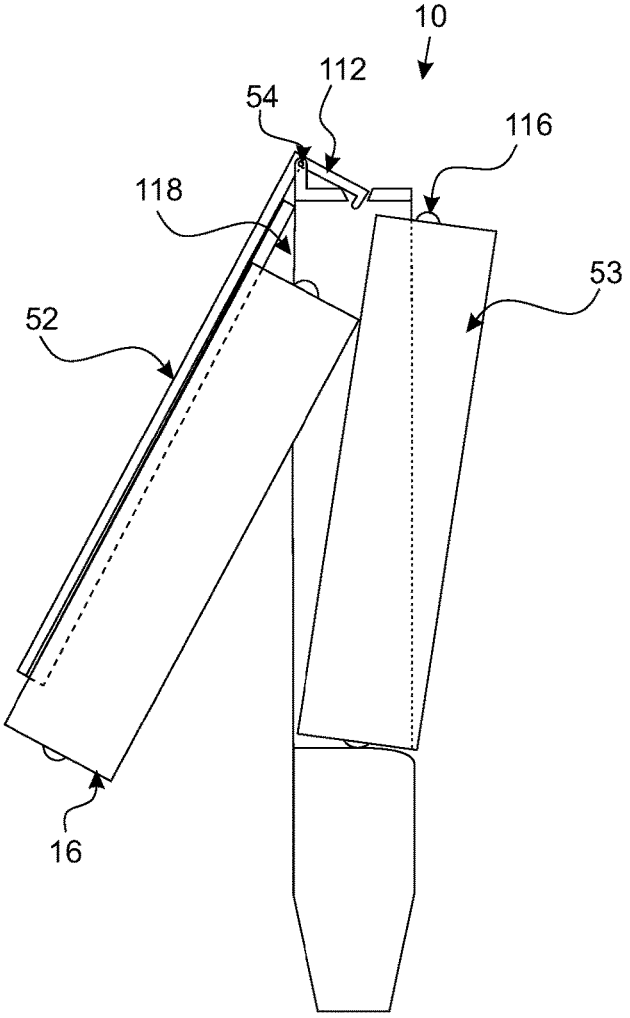
FIG. 21 is a top view of the handgun in FIG. 1, depicting the insertion of a loaded magazine in the magazine guide and expelling a spent magazine.
Figure 44:
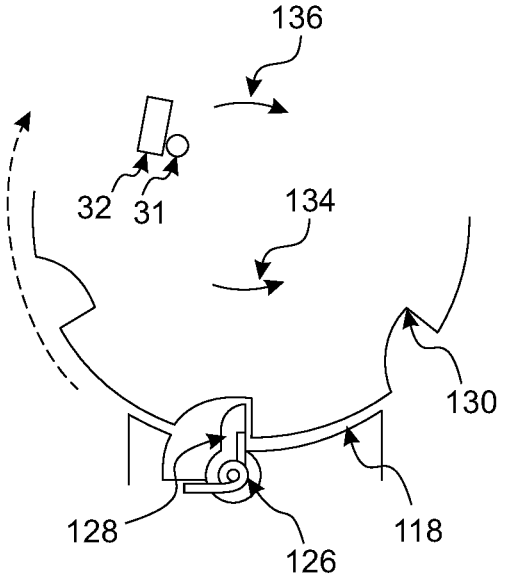
FIG. 44 is a rear cutaway view of a magazine for the handgun in FIG. 1, depicting a registration coil-spring assembly positioned within a notch in the gun frame, and further depicting the opposing forces exerted on the magazine.
Figure 45:
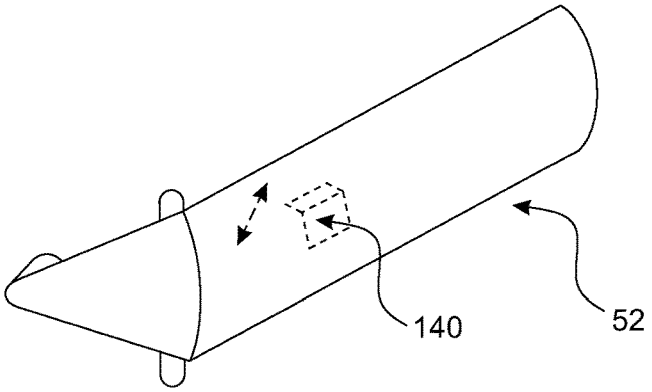
FIG. 45 is a front perspective view of the magazine guide of the handgun in FIG. 1, depicting an alternate registration leaf spring assembly and its directions of motion.
Figure 46:
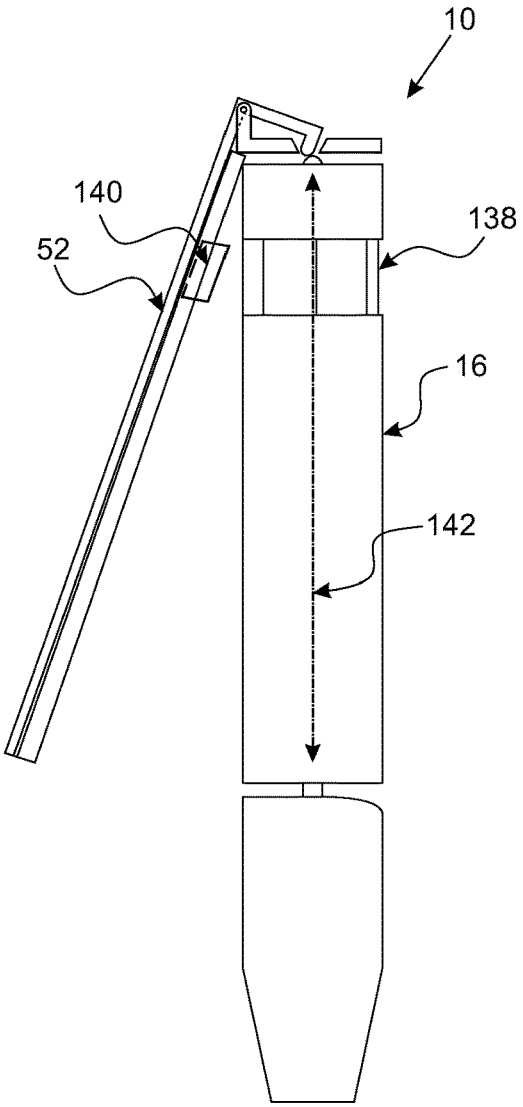
FIG. 46 is a top view of the handgun in FIG. 1, depicting an alternate registration leaf spring assembly affixed to a magazine guide and aligned with a plurality of alternate registration leaf spring notches disposed on the magazine.
Figure 47:
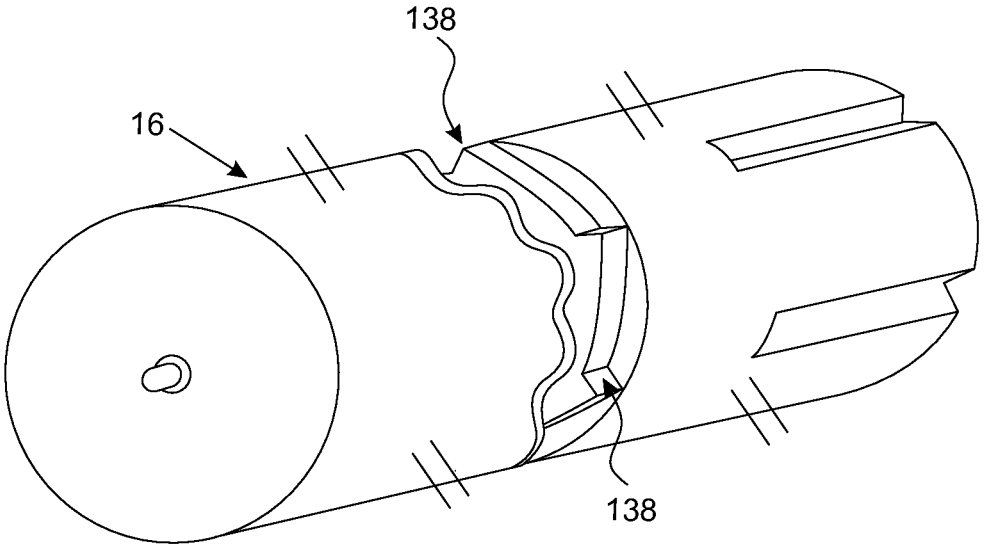
FIG. 47 is a front perspective view of a magazine for the handgun in FIG. 1, with a cutaway view depicting the alternate leaf spring registration notches molded into the surface of the magazine along its longitudinal axis.
Figure 48:
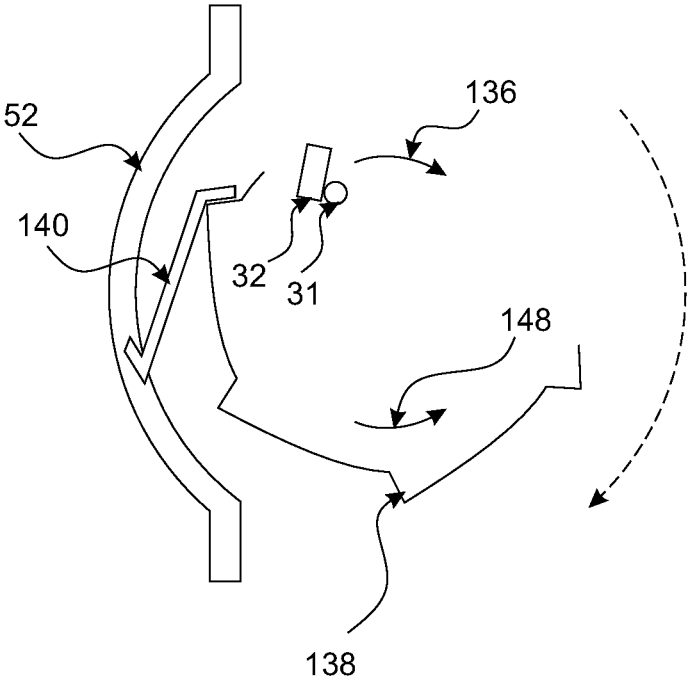
FIG. 48 is a rear cutaway view of a magazine for the handgun in FIG. 1, depicting an alternate registration leaf spring assembly, and further depicting the opposing forces exerted on the magazine.

Referring to FIGS. 41-44, for both embodiments, the registration notches 124,130 are molded to the magazine end, protruding from the cylindrical portion of the magazine, while the respective registration spring assembly 120,126 is located on the lower portion of the gun frame 118, situated below the muzzle end of the magazine 16 and aligned with the respective registration notches 124,130. Each registration spring assembly 120,126 is configured to be oriented in a manner that enables the respective spring assembly 120, 126 to catch a respective registration notch 124,130 (FIGS. 42,44). As such, each respective registration spring assembly 120,126 will exert a registration force 132,134 onto the magazine 16 that will oppose the force 136 exerted from a tube leaf spring 32, displaced by the leaf spring release pin 31, seeking to return to its original position while a hollow tube is aligned with the loading tray lever. The two opposing forces 132/134, 136 in essence cancel each other out, thereby inhibiting the magazine 16 from further rotation and enabling continued alignment between a hollow tube and the loading tray. Each registration notch 124,130 that the respective registration spring assembly 120,126 catches is positioned to inhibit the magazine 16 from rotating beyond the position of a corresponding tube leaf spring 32 displaced by the leaf spring release pin 31. As aforementioned, the loading tray lever will rotate the magazine 16 upon encountering an empty hollow tube. With reference to FIG. 16, an actuator 144 located on the slide 42 makes contact with the loading tray lever 46 due to the motion of the slide on its return, propelled by the dual coil springs 60 (FIG. 19). This transferred momentum of the returning slide 42, added to the force of the coil spring 146 on the loading tray lever 46, overcomes the force of the registration spring assembly 120,126 (FIGS. 42, 44) so that it allows the magazine 16 to rotate when the spring-guide-cap tip 30 (FIG. 18) is depressed by the loading tray bracket 39 (FIG. 18), and thereby enables the respective registration spring assembly 120,126 to catch the next registration notch 124,130.

Referring now to FIGS. 45-48, there is shown an alternate configuration for the registration leaf spring system, wherein a plurality of alternate leaf spring notches 138, identical in profile to the registration notches 124 in FIG. 41, are molded into the surface of the magazine 16 at any preferred location further back from the muzzle along the magazine 16 longitudinal axis 142. The alternate leaf spring notches 138 further circumscribe the magazine 16. The corresponding alternate leaf spring assembly 140 is affixed to the magazine guide 52, aligned with the location of the alternate leaf spring notches 138. As aforementioned for the other registration spring systems, each alternate leaf spring notch 138 is configured to securely catch the alternate leaf spring assembly 140, specifically an alternate leaf spring lever. Moreover, the alternate leaf spring assembly 140 is oriented in an inward manner (FIG. 48) enabling a respective alternate leaf spring notch 138 to be caught. Thus, as aforementioned, the alternate leaf spring assembly 140 will exert a force 148 onto the magazine 16 that will oppose the force exerted from a displaced tube leaf spring 32 seeking to return to its original position while a hollow tube is aligned with the loading tray lever. The magazine 16 is thus inhibited from further rotation, thereby enabling continued alignment between a hollow tube and the loading tray. Each alternate leaf spring notch 138 that the alternate leaf spring assembly 140 catches is positioned to inhibit the magazine 16 from rotating beyond the position of a corresponding tube leaf spring 32 displaced by the leaf spring release pin 31. As aforementioned, with reference to FIG. 16, the forward momentum of the actuator 144 located on the slide 42, coupled with the force of the coil spring 146 on the loading tray lever 46 overcome the force of the alternate leaf spring assembly 140 so that it allows the magazine 16 to rotate when the spring-guide-cap tip 30 (FIG. 18) is depressed by the loading tray bracket 39 (FIG. 18), and thereby enables the leaf spring assembly 140 to catch the next registration notch 138.

Figure 22:
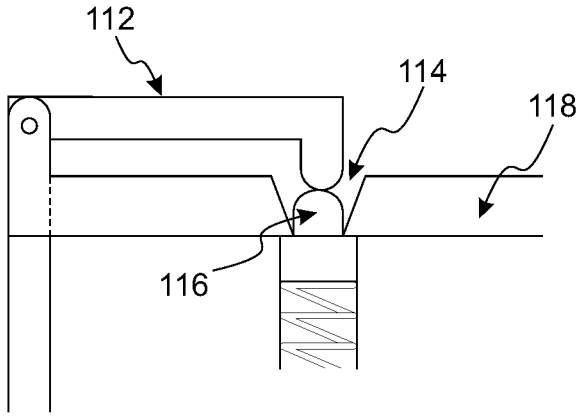
FIG. 22 represents a top view of the handgun in FIG. 1, depicting the magazine guide front-end and magazine rotating pin secured to the gun frame.
Figure 23:
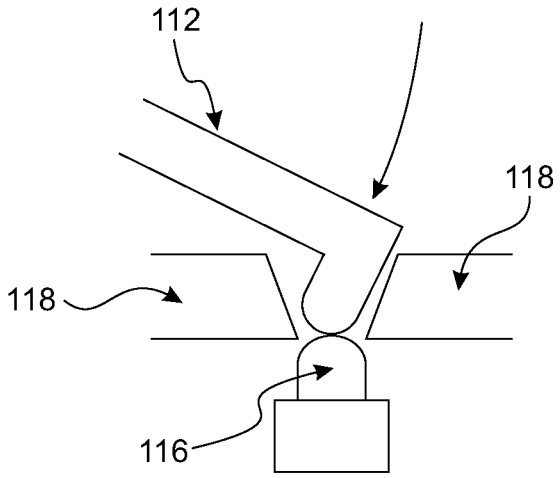
FIG. 23 represents a top view of the handgun in FIG. 1, depicting the magazine guide front-end rotated and the magazine rotating pin disengaged from the magazine well inset (gun frame inset).
Figure 24:
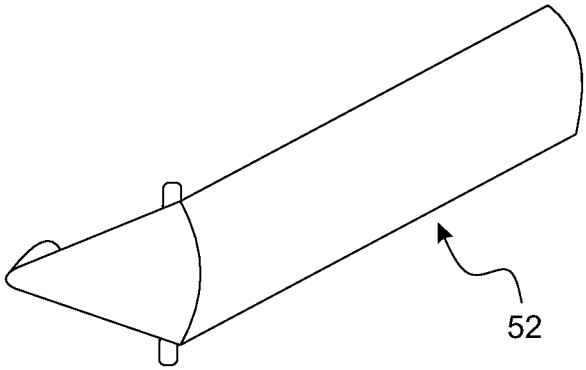
FIG. 24 is a front perspective view of the magazine guide of the handgun in FIG. 1, depicting the magazine guide configuration for receiving a loaded magazine.
Figure 25:
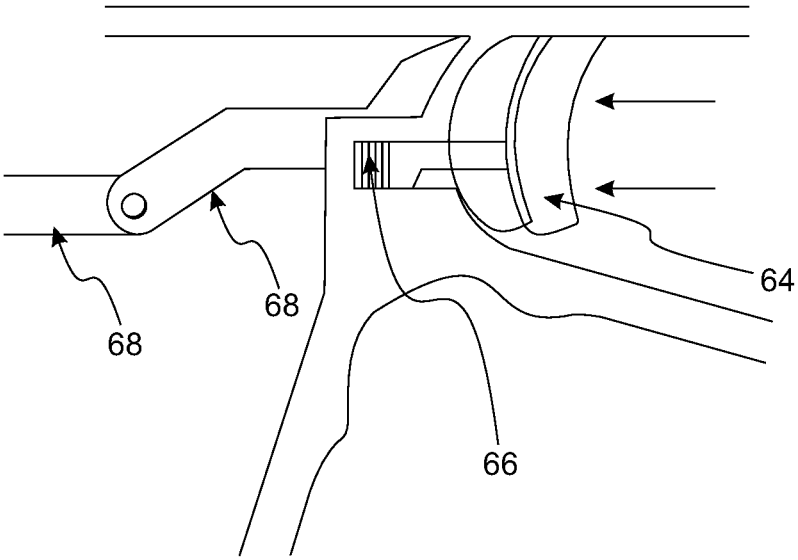
FIG. 25 is a side view of the handgun in FIG. 1, depicting a pulled trigger actuating other components of the handgun.

With reference now to FIGS. 20-24 and FIG. 49, the magazine well 12 is defined by the gun frame 118 and an adjacently located magazine guide 52 that can be released from its secured position beneath the barrel, via a release button located on a trigger guard (not shown). The released magazine guide 52 is rotated outwards and about a guide rotating axis 54, moving the magazine guide 52 away from the gun frame 118. The magazine guide 52 is configured (FIG. 24) to receive a magazine 16 once rotated outwards, which facilitates the release of a spent magazine 53. As depicted in FIG. 22, the magazine guide is shown secured to the gun frame 118, wherein the magazine guide front-end 112 is in contact with a magazine rotating pin 116 through an inset 114 on the gun frame 118. Releasing and rotating the magazine guide 52 causes the magazine guide front-end 112 to rotate as well (FIG. 23), pushing the rotating pin 116 of the spent magazine 53 through the gun frame inset 114 (magazine well inset), wherein the rotating pin 116 can be spring-loaded. As such, the insertion of a new magazine 16 (FIG. 21) pushes the spent magazine 53 out since the spent magazine 53 is no longer secured within the magazine well via the rotating pin 116 inserted through the gun frame inset 114. Rotating the magazine guide 52 inwards and securing it to the gun frame 118 completes the disposal of the spent magazine 53 from the gun frame 118, while also enabling the rotating pin of the new magazine 16 to be secured within the gun frame inset 114.

With reference now to FIGS. 16-17, and 19, and as aforementioned, the loading tray 34 is used to facilitate the transferring of rounds 22, one at a time, from the magazine 16 to the chamber 36 of the gun barrel. The gun slide 42, as aforementioned, can be cycled rearward and forward from its original position where the front of the slide is aligned with the muzzle 62 of the barrel. The gun slide 42 can cover the length of the top of the handgun, partially or fully enclosing the barrel 14. The gun slide 42 is connected to dual springs 60 that are affixed to the muzzle 62 which, in turn will pull the slide 42 back to its original position after moving rearward.

Prior to the handgun being fired for the first time, the gun slide 42 is manually moved rearward, wherein the rearward motion causes a wedge-shaped protrusion 44 at the bottom of the slide 42 to contact and depress a loading tray lever 46. The depressed loading tray lever 46 is pivoted up against the loading tray 34, raising the loading tray 34 and compressing the loading tray return spring (not shown) (FIG. 17). As a result, the round 22 contained on the loading tray is positioned behind the chamber 36 of the barrel. The dual springs 60 at the barrel muzzle 62 force the slide to return, wherein forward motion of the slide 42 strips the round 22 from the loading tray 34. An extractor 48, located on the slide 42, further grips onto the round 22 as it is pushed into the chamber 36, thereby sealing the chamber 36. Moreover, the forward moving slide 42 causes the wedge-shaped protrusion 44 to disengage with the loading tray lever 46, causing the loading tray 34 to be deactivated and return to its original position, where it receives the next round 22 from the aligned hollow tube 18, as depicted in FIG. 16.

Once the first round is fired, the slide 42 will be blown back by the recoil of the fired round. The extractor 48, in its rearward motion via the slide 42, draws the spent round 40 from the chamber 36 and causes it to be expelled through contact with a fixed ejector 50. Moreover, the recoil of the fired round automatically starts the cycle once again wherein the rearward motion of the slide lifts a new round 22 to be loaded into the chamber 36 of the barrel.

Figure 26:
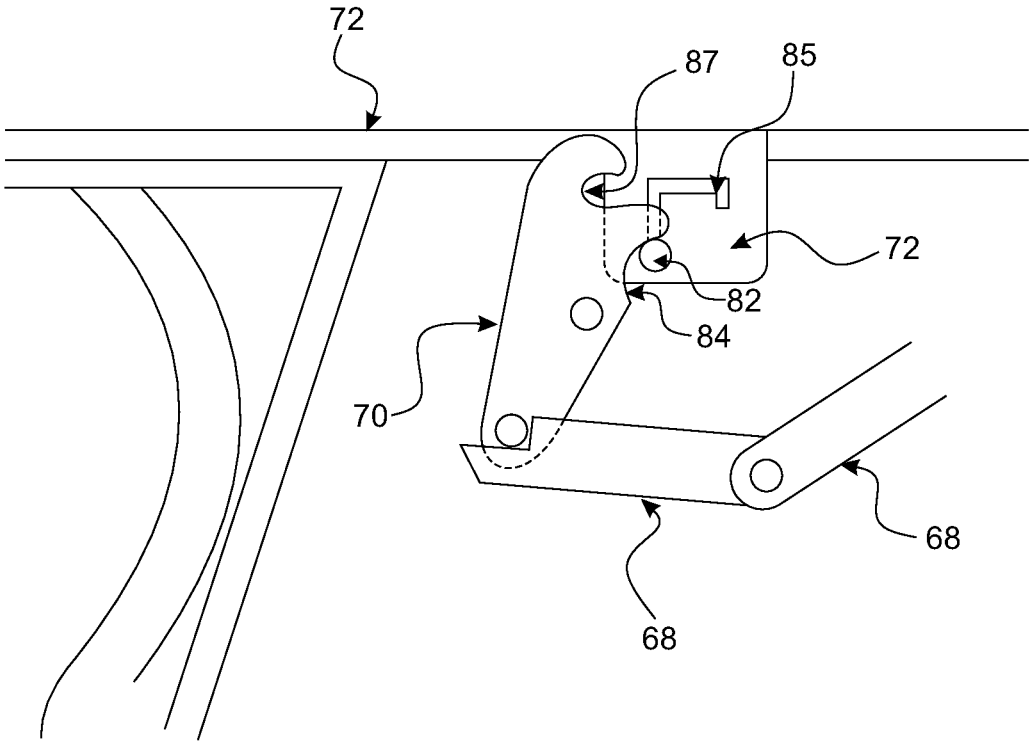
FIG. 26 is a side view of the handgun in FIG. 1, depicting a cam and cam-sear connector in automatic firing mode, in the fully forward position due to a pulled trigger.
Figure 27:
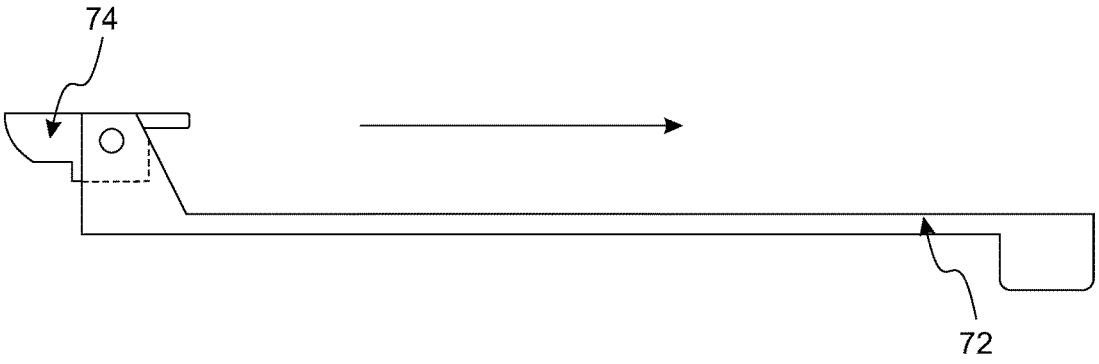
FIG. 27 is a side view of the handgun in FIG. 1, depicting a cam-sear connector and sear moving forward.
Figure 28:
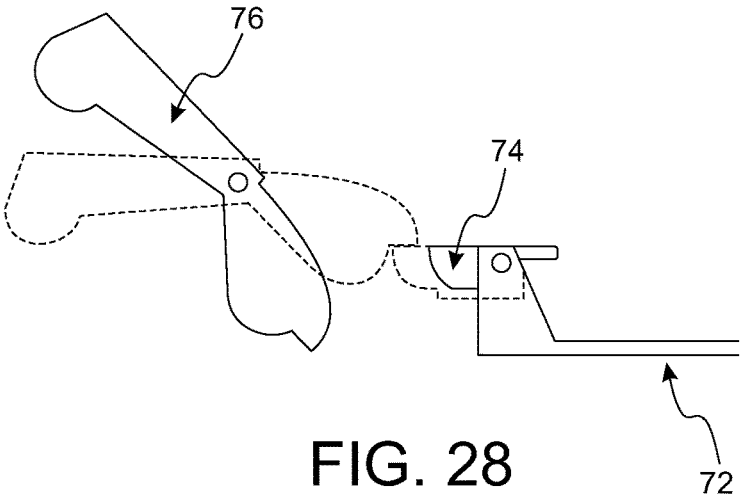
FIG. 28 is a progressive side view of the handgun in FIG. 1, depicting a sear moving forward, and a hammer moving upwards from its original position.
Figure 29:
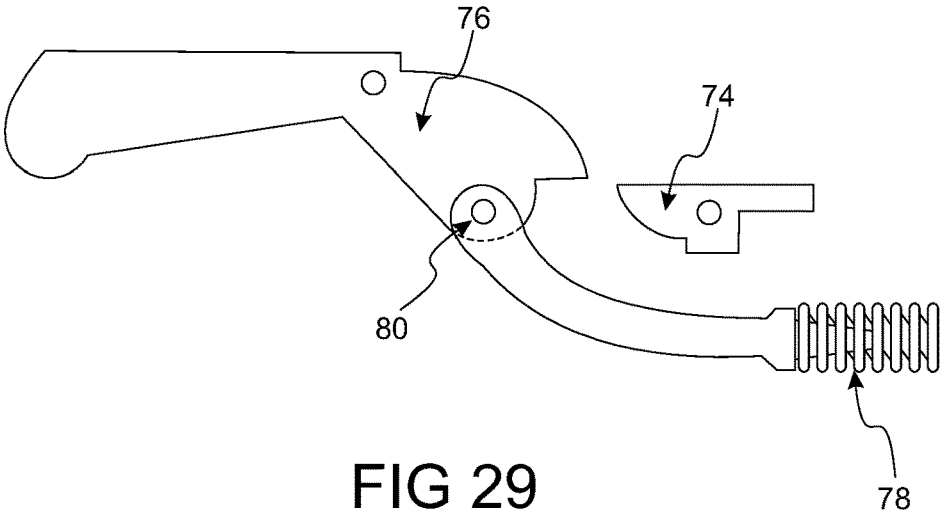
FIG. 29 is a side view of the handgun in FIG. 1, depicting a hammer connected to the hammer-spring assembly, and disengaged from the sear.

With reference now to FIGS. 25-29, the handgun trigger assembly includes the trigger 64, a trigger spring 66, a cam actuator 68, a cam 70, a cam-sear connector 72, a sear 74, a hammer 76, a hammer-spring assembly 78, a hammer actuator 80, and a cam-sear connector pin 82. Once the trigger 64 is pulled, it is pressed against the trigger spring 66 causing the cam actuator 68 to move a lower pin on the cam 70 backward, resulting in the upper end of the cam 70 to move forward. The upper end of the cam 70 is pressed against the cam-sear connector 72 and the cam-sear connector pin 82, causing the cam-sear connector 72 and consequently the sear 74 to move forward. Prior to the trigger 64 being pulled, the hammer 76 is under tension from the hammer-spring assembly 78 to move upward via the hammer actuator 80, but is prevented from doing so due to the contact between the hammer 76 and the sear 74. However, as depicted in FIGS. 27-28, the forward motion of the sear 74, through the pulled trigger 64, will release the hammer 76, causing it to move upwards rapidly. The hammer will subsequently strike a firing pin (not shown), located within the slide, which in turn, will strike a firing cap of the round and result in a detonation and release of the ammunition round.

As aforementioned, the slide will also move backwards due to the recoil of the fired round, causing the hammer 76 to overcome the hammer-spring assembly 78 tension and rotate back to its original position. The sear will have returned to its original position and thereby allow it to re-engage with the hammer 76, preventing the hammer 76 from moving upwards until the trigger 64 is pulled again.

Figure 30:
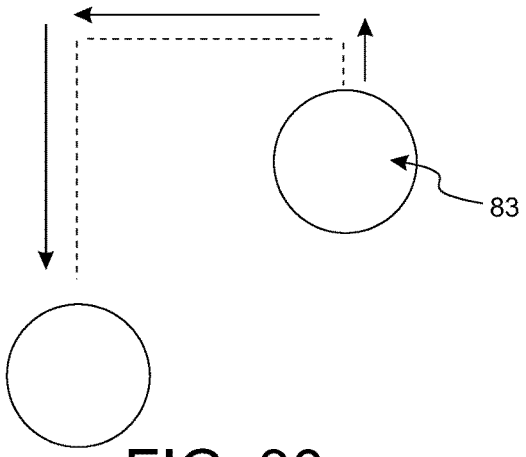
FIG. 30 is a lateral view of a selector switch affixed to the handgun in FIG. 1, depicting the movement and position of the selector switch moving from semi-automatic firing to fully automatic firing.

With reference now to FIGS. 26 and 30, the handgun contains a selector switch 83 with a spring-activated connection to the cam-sear connector pin 82 that enables the user to toggle the firing mechanism of the handgun between automatic and semi-automatic. Automatic firing enables the handgun to continuously fire and re-load when the trigger is pulled and held down in a pulled position. Semi-automatic firing limits the firing and re-load to one round when the trigger is pulled, even if the trigger is held down. The selector switch 83 is configured to be depressed, enabling it to move the position of the cam-sear connector pin 82 as guided through a selector slot 85 on the cam-sear connector 72. Once the selector switch 83 is released, it is no longer in contact with the cam-sear connector pin 82, thereby unaffected by any movement of the cam-sear connector 72. However, altering the position of the cam-sear connector pin 82 will alter the interaction between the cam 70 and cam-sear connector 72 when the trigger is pulled due to the contact between the cam 70 and the cam-sear connector pin 82 (as described below).

Figure 31:
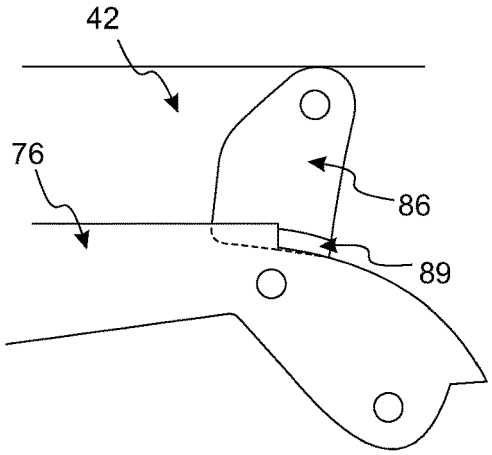
FIG. 31 is a side view of the handgun in FIG. 1, depicting an auto-sear inhibiting a hammer from moving upwards.
Figure 32:
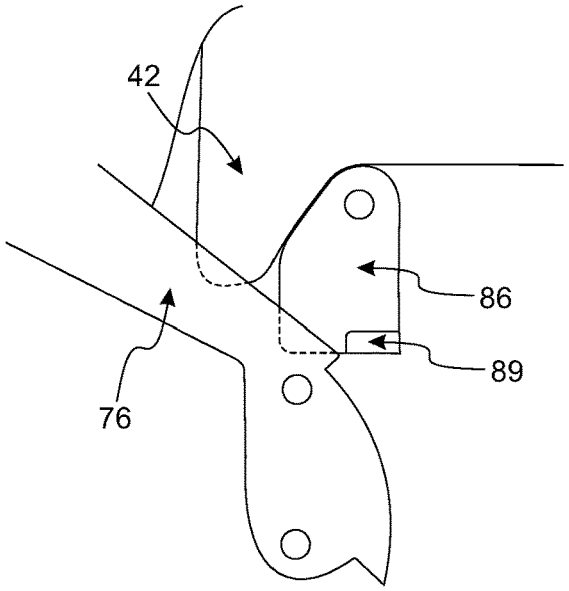
FIG. 32 is a side view of the handgun in FIG. 1, depicting an auto-sear disengaged from a hammer.

With reference to FIG. 26, a recess 84 shown on the cam 70 allows for fully automatic firing, while a notch 87 at the top of the cam 70 allows for semi-automatic firing. The selector switch-activated cam-sear connector pin 82 is shown (FIG. 26) in the automatic firing mode of the handgun on the cam-sear connector 72, wherein the cam-sear connector pin 82 is set in the recess 84 of the cam 70. Thus, as the cam 70 moves forward, it catches the cam-sear connector pin 82, resulting in the cam-sear connector 72 to also move forward. Due to the cam-sear connector pin 82 being lodged within the cam recess 84, a pulled trigger will hold the cam-sear connector 72, and thus sear 74, in the forward position due to the cam 70 being held in a forward position. As such, the sear 74 will be unable to re-engage with a hammer 76 that returns from the recoil of a fired round. Referring now to FIGS. 31-32, although the lack of sear engagement will cause the hammer 76 to move upwards during automatic firing, an auto-sear 86 is included that will be activated once the slide 42 moves rearward from the recoil of a fired round. The auto-sear 86 contains an auto-sear protrusion 89 that will contact and inhibit (FIG. 31) the hammer 76 from being released when the slide 42 is moved rearward. The auto-sear 86 will continue to inhibit the hammer from being released until the slide 42 moves forward (FIG. 32) and the chamber is sealed, at which point the hammer 76 will strike the firing pin and commence the detonation process. The auto sear 86 is located adjacent to the hammer 76 and is activated/deactivated by being pushed by the slide 42. As such, the cycled motion of the slide 42 resulting in the firing and re-loading of a round will occur continuously until the magazine is empty or the trigger is released.

Referring to FIG. 26, moving the cam-sear connector pin 82 from the depicted location to the opposite end of the selector slot 85 will set the handgun in semi-automatic firing mode. By contrast, referring to FIGS. 33-34, the handgun depicted contains a trigger assembly configured only for semi-automatic firing, i.e. incapable of automatic firing. However, the general trigger assembly operation for semi-automatic firing for the handguns depicted in FIGS. 26, 33 and 34 is similar, with the main difference being that the trigger assembly as depicted in FIGS. 33 and 34 do not contain a selector switch, and thus the cam-sear connector pin 82 location is fixed as opposed to being movable.

Figure 33:
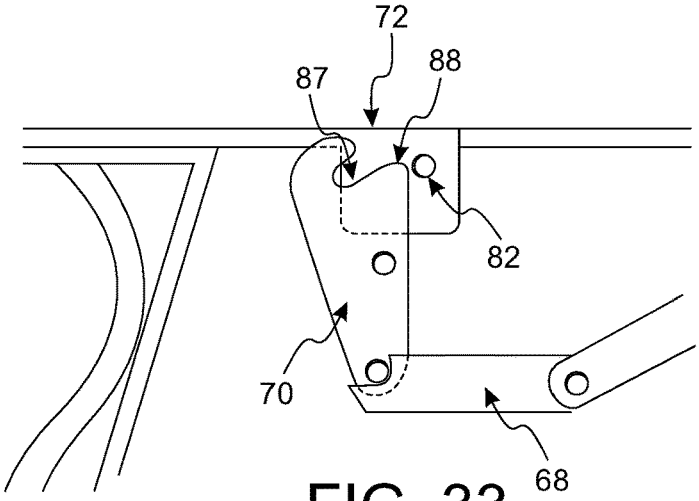
FIG. 33 is a side view of the handgun in FIG. 3, depicting a cam configured for only semi-automatic firing of the handgun.
Figure 34:
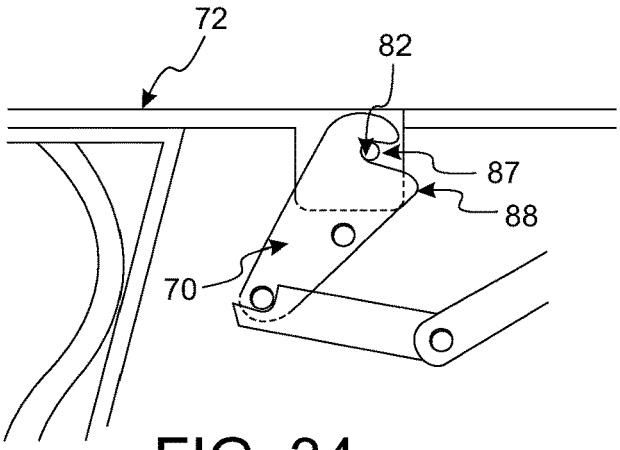
FIG. 34 is a side view of the handgun in FIG. 3, depicting a cam in a forward position due to a pulled trigger.

Referring now to FIG. 33, during semi-automatic firing and prior to the trigger being pulled, the cam-sear connector pin 82 is located adjacent to a cam bend 88. As the cam 70 moves forward, the contact between the cam bend 88 and cam-sear connector pin 82 cause the cam-sear connector 72 and sear to move forward. However, the cam-sear connector pin 82 remains in contact with the cam bend 88 just long enough to release the hammer 76, before slipping by the cam bend 88 on the cam 70, and returning the sear and cam-sear connector 72 to the respective original position, as depicted in FIG. 34, wherein the trigger is still pulled. Thus, regardless of whether the trigger is held down, the sear will re-engage with the hammer 76 to prevent any subsequent rounds from being fired. The cam notch 87 provides a backstop that enables the cam-sear connector pin 82 to return to its original position, and further helps prevent the cam-sear connector pin 82 from slipping past the cam 70 or vice versa.

Figure 35:
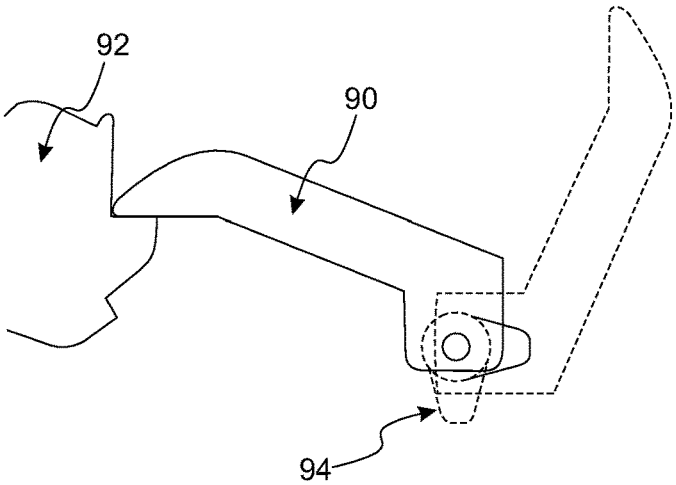
FIG. 35 is a progressive side view of the handgun in FIG. 1, depicting a sear-arm being rotated to engage with an inhibitor cog after a burst switch is rotated counterclockwise.
Figure 36:
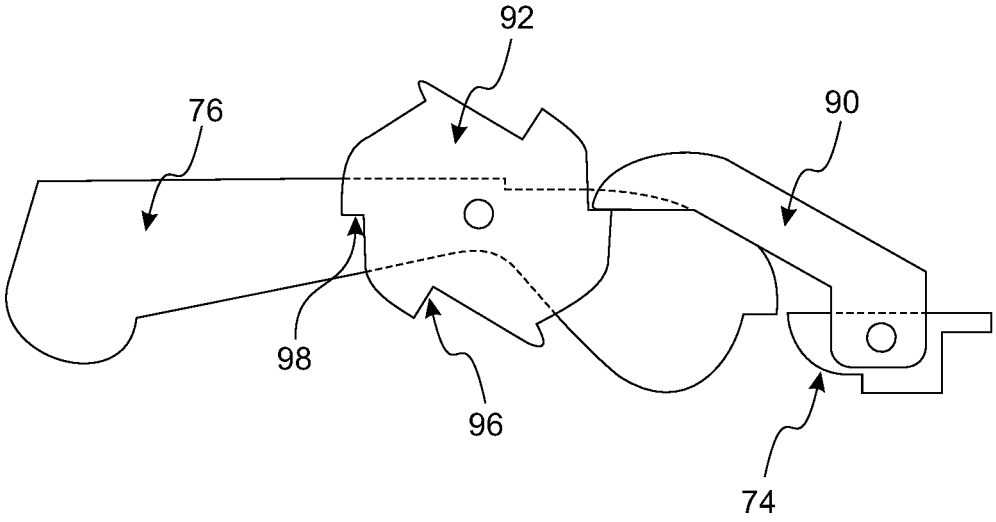
FIG. 36 is a side view of the handgun in FIG. 1, depicting a sear-arm engaged with a shallow recess on the inhibitor cog.
Figure 37:
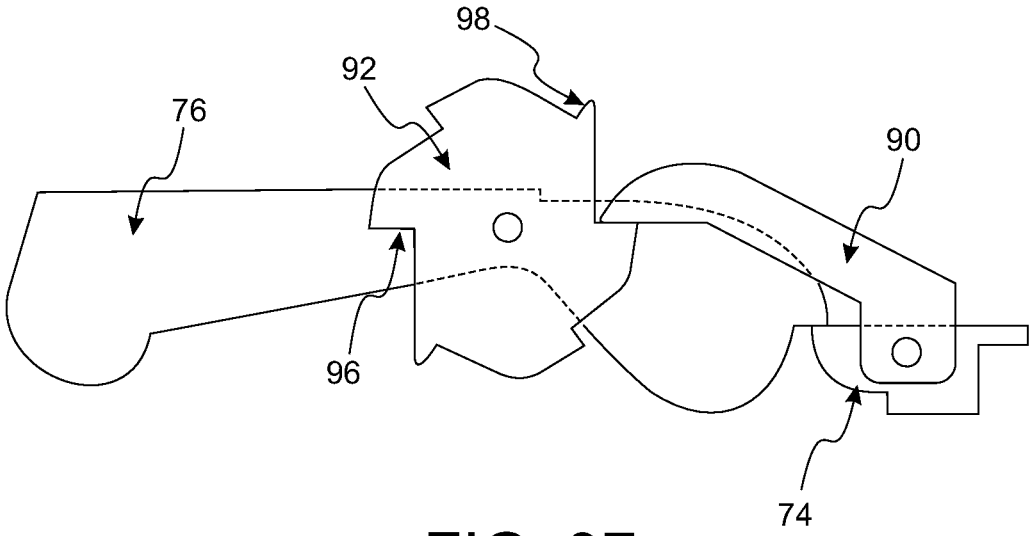
FIG. 37 is a side view of the handgun in FIG. 1, depicting a sear-arm engaged with a deep recess on the inhibitor cog.

With reference now to FIGS. 35-37, the handgun is further capable of being placed in a three-round burst firing mode, wherein three rounds are fired consecutively with a single pull of the trigger. The handgun must first be in semi-automatic firing mode, otherwise the handgun will not stop at firing three rounds consecutively. A three-round burst switch 94 located beneath the slide is rotated counterclockwise, thereby rotating a sear-arm 90 located about the sear 74 to engage with an inhibitor cog 92 acting as a cam about the hammer 76. The inhibitor cog 92 defines six recesses disposed about its circumference, wherein two of the recesses are identified as deep recesses 96, and four of the recesses are identified as shallow recesses 98. The arrangement of the recesses about the inhibitor cog for the exemplary embodiment include two consecutive shallow recesses 98 followed by one deep recess 96. When the sear-arm 90 is first engaged (FIG. 35), it is in contact with a deep recess, wherein the sear 74 is still engaged with the hammer 76 and preventing it from being released. Once the trigger is pulled, the hammer 76 will be released, firing the round, after which the hammer 76 will be forced down by the rearward motion of the slide due to the recoil of the fired round. As the hammer 76 is forced down, it will partially rotate the inhibitor cog 92, wherein the sear-arm 90 will engage with a shallow recess 98 (FIG. 36), thereby preventing the sear 74 from engaging with the hammer 76. As such, the hammer 76 can strike the firing pin again, once the auto-sear has been deactivated, causing the cycle to repeat. After the second round has been fired, the inhibitor cog 92 will partially rotate again such that a second shallow recess 98 will engage with the sear-arm 90, preventing the sear 74 to re-engage with the hammer 76, and allowing the firing process to repeat again. After the third consecutive round has been fired, the inhibitor cog 92 will rotate again wherein the sear-arm 90 will now engage a deep recess 96 (FIG. 37), which results in the hammer 76 rotating sufficiently to re-engage with the sear 74 and prevent further firing.

Figure 38:
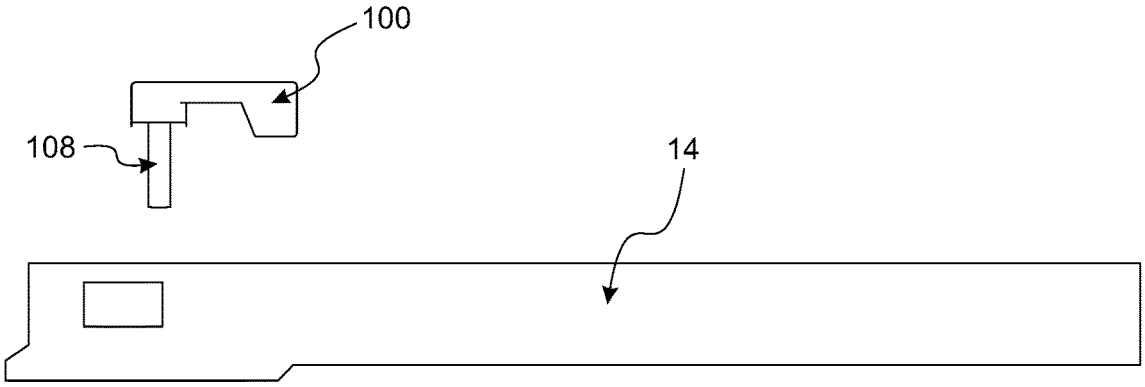
FIG. 38 is a side view of the barrel of the handgun in FIG. 1, depicting the barrel removed from the handgun along with a disengaged locking lug and locking lug lever.
Figure 39:
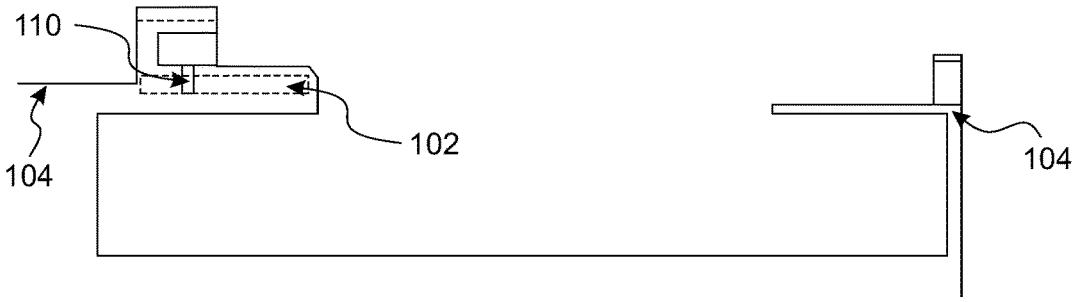
FIG. 39 is a side view of the handgun in FIG. 1, depicting a barrel frame with a barrel locking rail and hole to receive a locking lug, wherein the barrel has been removed.
Figure 40:
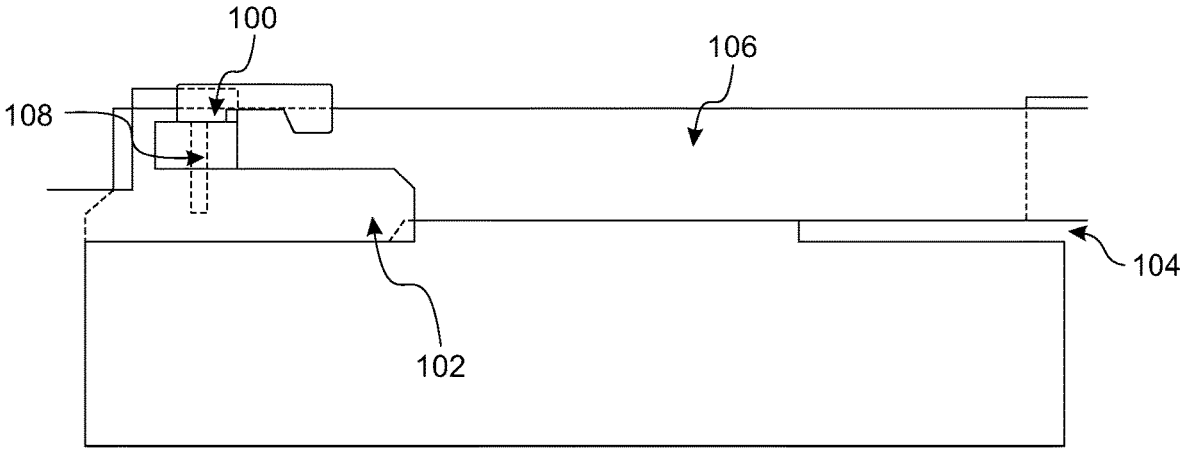
FIG. 40 is a side view of the handgun in FIG. 1, depicting the locking lug configuration in securing the barrel with the locking rail support frame assembly.
Figure 49:
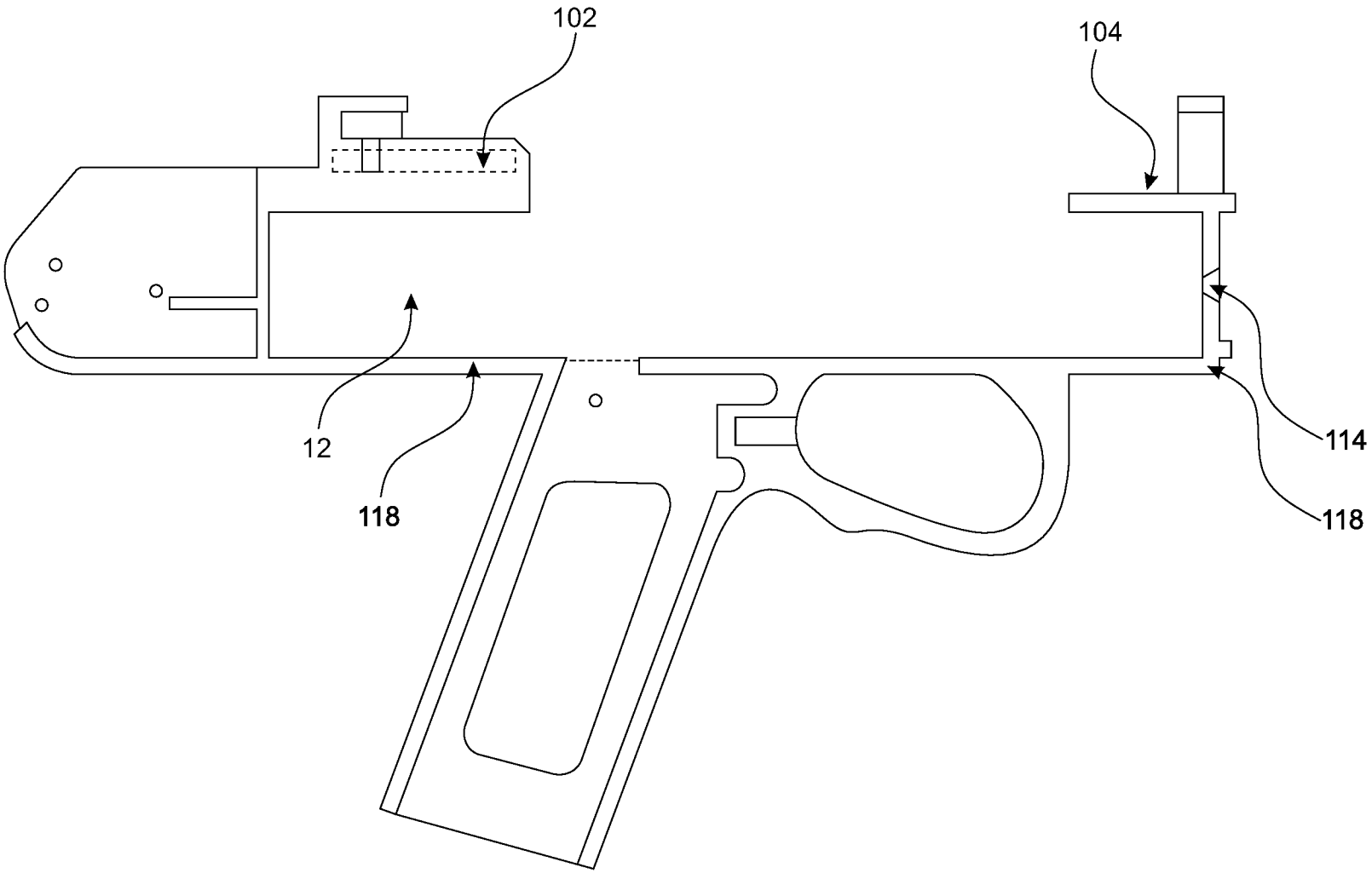
FIG. 49 is a side view of a gun frame for the handgun in FIG. 1, depicting the gun frame without a barrel, the magazine well, the magazine well inset (gun frame inset), and the barrel support frame.

With reference now to FIGS. 38-40, the handgun barrel 14 is separable and replaceable, particularly in situations where the barrel becomes too hot during rapid fire of the handgun. The barrel 14 is held in place through a removable locking lug 108 shown disengaged in FIG. 38, which contains a corresponding locking lug lever 100. The locking lug 108 is placed adjacent to the chamber of the barrel, wherein a hole 110 in the barrel support frame receives the locking lug 108. Once the locking lug 108 is removed, via rotation of the locking lug lever 100, the barrel 14 and chamber can be pushed out of the barrel locking rail 102, where it can then be removed from the barrel support frame 104, and replaced with a cool barrel 106. The barrel support frame 104 is a portion of the gun frame 118 disposed above the magazine well 12 (FIG. 49). The cool barrel 106 and chamber are subsequently pushed into the barrel support frame 104, and then backwards along the barrel locking rail 102. The cool barrel 106 is locked in place by inserting the locking lug 108 through a hole on the cool barrel 106 and the barrel support frame hole 110 (FIG. 39), followed by rotating the locking lug lever 100.

It should be appreciated from the foregoing that the present invention provides a handgun/pistol with a high capacity magazine aligned and disposed beneath the gun barrel. The magazine defines a plurality of hollow tubes arranged radially around a central axis about which the magazine can rotate automatically during operation of the handgun/pistol. The hollow tubes each contain a plurality of ammunition rounds, and can each be aligned with a loading tray one at a time, wherein a coil spring will push out a single round at a time onto the loading tray. The handgun uses a gun slide to load a new round into the chamber of the gun barrel via the loading tray. Moreover, the slide will re-set a hammer to re-engage with a sear, after a pulled trigger releases the hammer to strike a firing pin. The handgun can further be equipped with a selector switch enabling automatic and semi-automatic firing modes, wherein the semi-automatic firing mode can be further specified to select a three-round burst fire mode. The handgun can also be configured with a simpler firing mode cam and fewer parts that limits it to semi-automatic firing mode. Additionally, the handgun barrel is separable and replaceable if the barrel becomes too hot after rapid fire.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A handgun comprising:

a barrel having a proximal opening and a muzzle disposed at a distal end thereof, the barrel defining a longitudinal axis;

a gun frame coupled to the barrel, the gun frame defining a magazine well that is disposed below the barrel;

a magazine mounted to the magazine well such that the magazine is disposed below the barrel, the magazine defining a central axis aligned with the longitudinal axis of the barrel, the magazine including a body that defines a plurality of hollow tubes arranged radially about the central axis, each hollow tube of the plurality of hollow tubes is configured to hold a plurality of ammunition rounds, each hollow tube of the plurality of hollow tubes is longitudinally aligned with the central axis, the magazine including a plurality of coil springs, each coil spring of the plurality of coil springs is located within a respective hollow tube of the plurality of hollow tubes;

a rotating fixture coupled to the magazine, longitudinally aligned with the central axis, the rotating fixture enabling the magazine to rotate about the central axis while the magazine remains mounted to the magazine well;

a registration spring system disposed beneath the barrel, configured to inhibit rotation of the magazine in a first direction to ensure a respective loaded hollow tube of the plurality of hollow tubes remains aligned with a loading tray, the registration spring system comprising 1) a plurality of registration notches circumscribing the magazine and 2) a registration spring assembly aligned with and spaced apart from the plurality of registration notches, wherein the registration spring assembly includes a spring lever configured to catch a respective registration notch to inhibit further magazine rotation in the first direction; wherein a lowered loading tray fore-end catching a spring-guide tip of an empty hollow tube will automatically depress the spring lever via rotation of the magazine in the first direction, resulting an adjacent registration notch of the plurality of notches to release and catch the spring lever thereof; wherein each registration notch of the plurality of registration notches is rotationally aligned with a corresponding displaced tube leaf spring of a plurality of tube leaf springs positioned on a proximal end of the magazine, to prevent a leaf spring release pin disengaging from the corresponding tube leaf spring by inhibiting additional rotation of the magazine in the first direction, wherein the plurality of registration notches are disposed on a distal end of the magazine, and the registration spring assembly is located below the plurality of registration notches; and a handgrip coupled to the gun frame such that the handgrip is aligned below both the magazine and the barrel.

2. The handgun as defined in claim 1, further comprising a gun slide slidably mounted proximate to the proximal opening of the barrel and aft of the handgrip for movement aligned with the longitudinal axis of the barrel.

3. The handgun as defined in claim 2, further comprising a loading tray assembly, the loading tray assembly having:

a loading tray lever coupled to the gun slide and actuated by rearward motion of the gun slide relative to the barrel; and the loading tray coupled to the loading tray lever to move the loading tray, via actuation of the loading tray lever, between a first location proximate to the magazine and a second location proximate to the proximal opening of the barrel, the first location of the loading tray is aligned with a proximal end of a hollow tube of the plurality of tubes, to receive one of the plurality of ammunition rounds therefrom, pushed out by the respective coil spring, in the second location the loading tray delivers the received ammunition round in alignment with the barrel.

4. The handgun as defined in claim 3, wherein the loading tray lever is configured to lower the loading tray from the second location to the first location, via a returning forward motion of the gun slide relative to the barrel, enabling the loading tray to receive a second ammunition round of the plurality of ammunition rounds to be pushed out by the respective coil spring within a first hollow tube of the plurality of hollow tubes.

5. The handgun as defined in claim 1, wherein each of the plurality of coil springs is inserted into a spring guide-cap, and each spring guide-cap includes the spring guide tip that protrudes from a respective hollow tube of the plurality of hollow tubes that has pushed out all of the ammunition rounds of the plurality of ammunition rounds herein.

6. The handgun as defined in claim 1, wherein the plurality of tube leaf springs circumscribe the proximal end of the magazine, each tube leaf spring of the plurality of tube leaf springs partially covering a proximal end of a respective hollow tube of the plurality of hollow tubes, to prevent the release of ammunition rounds from the respective hollow tube of the plurality of hollow tubes.

7. The handgun as defined in claim 6, wherein the leaf spring release pin is disposed below the barrel and configured to displace a first tube leaf spring of the plurality of tube leaf springs corresponding to a first hollow tube of the plurality of hollow tubes aligned with the loading tray, thereby enabling the release of ammunition rounds from the first hollow tube of the plurality of hollow tubes, wherein the rotation of the magazine returns the first tube leaf spring to an original position, and causes the leaf spring release pin to displace a second tube leaf spring of the plurality of tube leaf springs corresponding to a second hollow tube of the plurality of hollow tubes aligned with the loading tray.

8. The handgun as defined in claim 1, wherein the plurality of registration notches are disposed between the distal and the proximal ends of the magazine, and the registration spring assembly is mounted to a magazine guide that is disposed adjacent to the magazine well.

9. A handgun comprising:

a barrel having a proximal opening and a muzzle disposed at a distal end thereof, the barrel defining a longitudinal axis;

a gun frame coupled to the barrel, the gun frame defining a magazine well that is disposed below the barrel;

a magazine mounted to the magazine well such that the magazine is disposed below the barrel, the magazine defining a central axis aligned with the longitudinal axis of the barrel, the magazine configured to rotate about the central axis while the magazine remains mounted to the magazine well, the magazine including a body that defines a plurality of hollow tubes arranged radially about the central axis, each hollow tube of the plurality of hollow tubes is sized to hold a plurality of ammunition rounds, each hollow tube of the plurality of hollow tubes is longitudinally aligned with the central axis, the magazine including a plurality of coil springs, each coil spring of the plurality of coil springs is located within a respective hollow tube of the plurality of hollow tubes;

a gun slide mounted proximate to the proximal opening of the barrel for movement aligned with the longitudinal axis of the barrel;

a loading tray assembly includes a loading tray actuated by the gun slide for movement between a first location proximate to the magazine and a second location proximate to the proximal opening of the barrel, to deliver ammunition from the first location to the second location;

a registration spring system configured to inhibit rotation of the magazine in a first direction, the registration spring system including a plurality of registration notches circumscribing the magazine, rotationally aligned with a corresponding displaced tube leaf spring position on a proximal end of the magazine, to prevent the leaf spring release pin disengaging from the corresponding tube leaf spring by inhibiting additional rotation of the magazine in the first direction, and a registration spring assembly aligned with and spaced apart from the plurality of registration notches, the registration spring assembly is located below the plurality of registration notches, wherein the registration spring assembly includes a spring lever configured to catch a registration notch plurality of registration notches to inhibit further magazine rotation in the first direction, the plurality of registration notches are disposed between the distal and the proximal ends of the magazine, and the registration spring assembly is mounted to a magazine guide that is disposed adjacent to the magazine well; and a handgrip coupled to the gun frame such that the handgrip is aligned below both the magazine and the barrel.

10. The handgun as defined in claim 9, further comprising a plurality of tube leaf springs circumscribing the proximal end of the magazine, each tube leaf spring of the plurality of tube leaf springs partially covering a proximal end of a respective hollow tube of the plurality of hollow tubes, to prevent the release of ammunition rounds from the respective hollow tube of the plurality of hollow tubes.

11. The handgun as defined in claim 10, further comprising a leaf spring release pin disposed below the barrel, the leaf spring release pin configured to displace a first tube leaf spring corresponding to a first hollow tube of the plurality of hollow tubes aligned with a loading tray, thereby enabling the release of ammunition rounds from the first hollow tube of the plurality of hollow tubes, wherein rotation of the magazine returns the first tube leaf spring to an original position, and causes the leaf spring release pin to displace a second tube leaf spring of a second hollow tube of the plurality of hollow tubes aligned with the loading tray.

12. The handgun as defined in claim 9, the loading tray further having a fore-end sized to catch a spring-guide tip of an empty hollow tube of the plurality of hollow tubes to depress the spring lever via rotation of the magazine in the first direction, resulting an adjacent registration notch of the plurality of notches to release and catch the spring lever thereof.

* * * * *